US008608587B2

(12) United States Patent
Henrikson et al.

(10) Patent No.: US 8,608,587 B2
(45) Date of Patent: Dec. 17, 2013

(54) GOLF CLUB HEADS WITH TURBULATORS AND METHODS TO MANUFACTURE GOLF CLUB HEADS WITH TURBULATORS

(75) Inventors: Erik M. Henrikson, Mesa, AZ (US); Paul D. Wood, Phoenix, AZ (US); John Hert, Sheffield (GB); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 13/536,753

(22) Filed: Jun. 28, 2012

(65) Prior Publication Data

US 2013/0109494 A1 May 2, 2013

Related U.S. Application Data

(60) Provisional application No. 61/553,428, filed on Oct. 31, 2011, provisional application No. 61/651,392, filed on May 24, 2012.

(51) Int. Cl.
*A63B 53/04* (2006.01)

(52) U.S. Cl.
USPC ..... 473/324; 473/327; 473/328; 473/345; 473/409

(58) Field of Classification Search
USPC ..... 473/324, 327, 328, 345, 409, 226, 228, 473/344; D21/733, 752, 759
See application file for complete search history.

(56) References Cited

U.S. PATENT DOCUMENTS

D192,515 S * 4/1962 Henrich ..... D21/733
3,997,170 A * 12/1976 Goldberg ..... 473/327
4,065,133 A * 12/1977 Gordos ..... 473/327
4,077,633 A 3/1978 Studen
4,754,974 A 7/1988 Kobayashi
5,092,599 A 3/1992 Okumoto et al.
5,190,289 A 3/1993 Nagai et al.
5,193,810 A * 3/1993 Antonious ..... 473/327
5,213,328 A 5/1993 Long et al.

(Continued)

FOREIGN PATENT DOCUMENTS

JP 03-114477 5/1991

OTHER PUBLICATIONS

Description and Images of TaylorMade Golf R11 Fairway Wood Golf Club from http://www.taylormadegolf.com/products/fairways/R11s-fairway, printed from Internet, Jan. 25, 2012.

(Continued)

*Primary Examiner* — Sebastiano Passaniti

(57) ABSTRACT

A golf club head includes a crown surface extending between the face, the rear, the heel and the toe of the golf club head. A highest point on the surface of the crown defines an apex. The golf club head also includes a plurality of crown turbulators projecting from the surface of the crown. Each adjacent pair of crown turbulators is separate and spaced apart to define a space between the adjacent pair of crown turbulators, and each crown turbulator extends between the heel and the toe to define a width and extending between the face and the rear to define a length, which is substantially greater than the width. At least a portion of at least one crown turbulator is located between the face and the apex. The space between each adjacent pair of crown turbulators is substantially greater than the width of each of the adjacent pair of crown turbulators that define the space.

28 Claims, 13 Drawing Sheets

(56) References Cited

U.S. PATENT DOCUMENTS

| | | | | |
|---|---|---|---|---|
| 5,213,329 | A * | 5/1993 | Okumoto et al. | 473/328 |
| 5,271,622 | A * | 12/1993 | Rogerson | 473/234 |
| D354,784 | S * | 1/1995 | Long et al. | D21/752 |
| 5,441,263 | A * | 8/1995 | Gorman | 473/349 |
| 6,605,006 | B2 * | 8/2003 | Mason | 473/252 |
| 6,679,781 | B1 | 1/2004 | Green | |
| 7,258,625 | B2 | 8/2007 | Kawaguchi et al. | |
| 7,641,568 | B2 | 1/2010 | Hoffman et al. | |
| 7,988,565 | B2 * | 8/2011 | Abe | 473/328 |
| 8,366,565 | B2 * | 2/2013 | Tavares et al. | 473/324 |
| 2002/0077195 | A1 | 6/2002 | Carr et al. | |
| 2003/0220154 | A1 | 11/2003 | Anelli | |
| 2010/0016095 | A1 | 1/2010 | Burnett et al. | |
| 2010/0292020 | A1 | 11/2010 | Tavares et al. | |

OTHER PUBLICATIONS international Search Report from Corresponding PCT Application No. PCT/US2012/045380, dated Feb. 1, 2013.

Written Opinion of the International Searching Authority from corresponding PCT application No. PCT/US2012/045380, dated Feb. 1, 2013.

* cited by examiner

Fig. 21
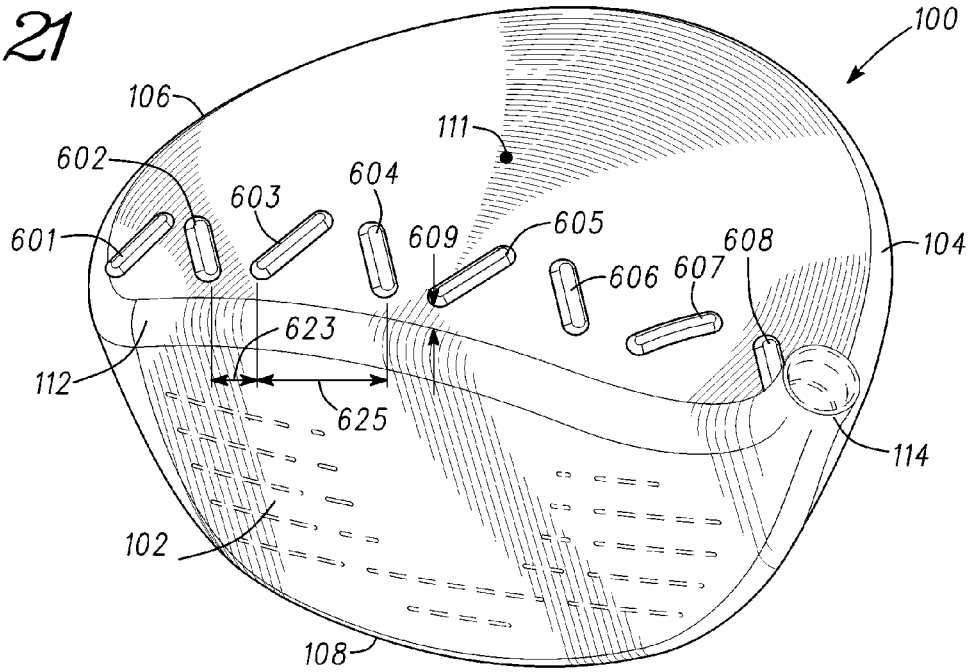
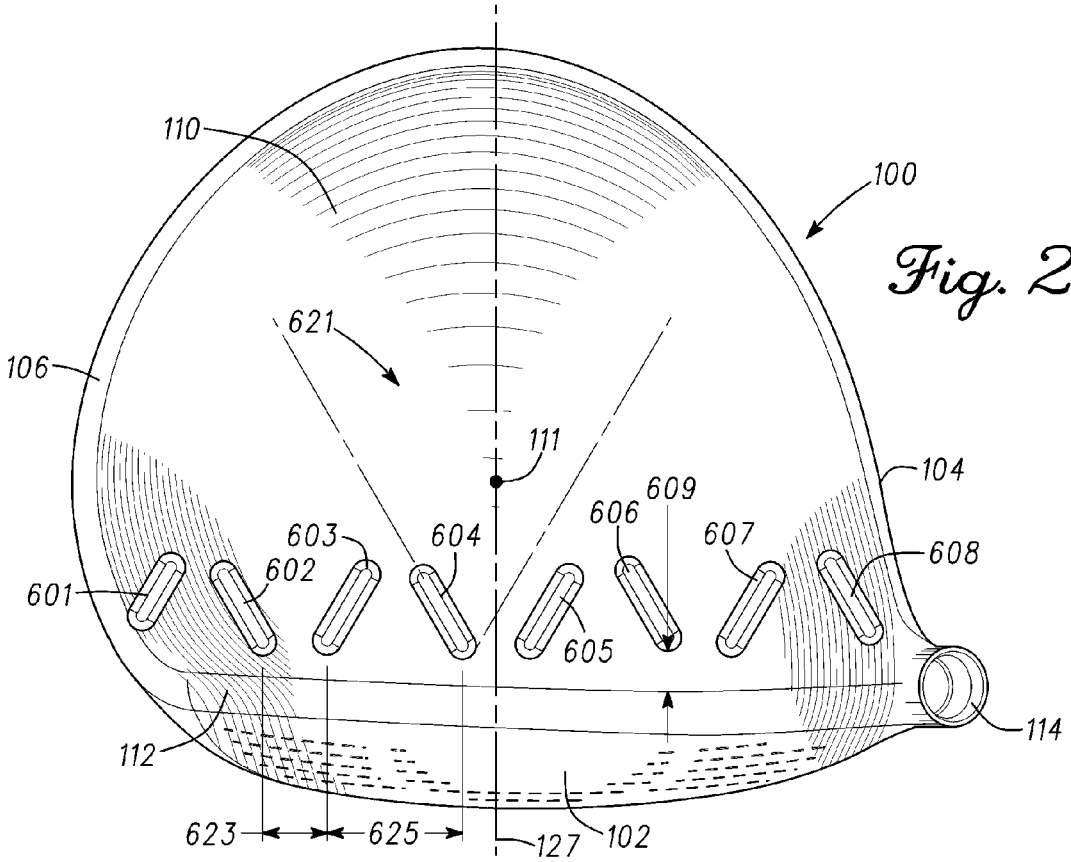
Fig. 22

GOLF CLUB HEADS WITH TURBULATORS AND METHODS TO MANUFACTURE GOLF CLUB HEADS WITH TURBULATORS

CROSS-REFERENCE TO RELATED APPLICATIONS

The present application claims the benefit of U.S. Provisional Patent Application Ser. No. 61/553,428 filed on Oct. 31, 2011, and U.S. Provisional Patent Application Ser. No. 61/651,392 filed on May 24, 2012, the entire disclosures of which are incorporated herein by reference.

FIELD

The present application generally relates to golf clubs, and more particularly, to golf club heads with turbulators and methods to manufacture golf club heads with turbulators.

BACKGROUND

When air flows over a golf club head, viscous forces near the surface of the club head create a velocity gradient from the surface to the free stream region. Accordingly, air flow velocity near the surface may be relatively slow and gradually increases toward the free stream velocity, which is the air flow region where air velocity is not influenced by the club head. This velocity gradient region is called a boundary layer. Flow separation occurs when the boundary layer travels on the golf club head far enough against an adverse pressure gradient that the air flow velocity in the boundary layer relative to the surface of the club head falls almost to zero. The air flow becomes detached from the surface of the club head and takes the form of eddies and vortices. Flow separation may result in increased drag, which may be caused by the pressure differential between the front and rear surfaces of the club head. The increased drag may reduce the speed of the club head, which in turn may lower the velocity of a golf ball that is struck by the club head.

BRIEF DESCRIPTION OF THE DRAWINGS

FIGS. 21 and 22 are perspective views of a club head having a turbulator according to one embodiment.

DETAILED DESCRIPTION

Figure 1:
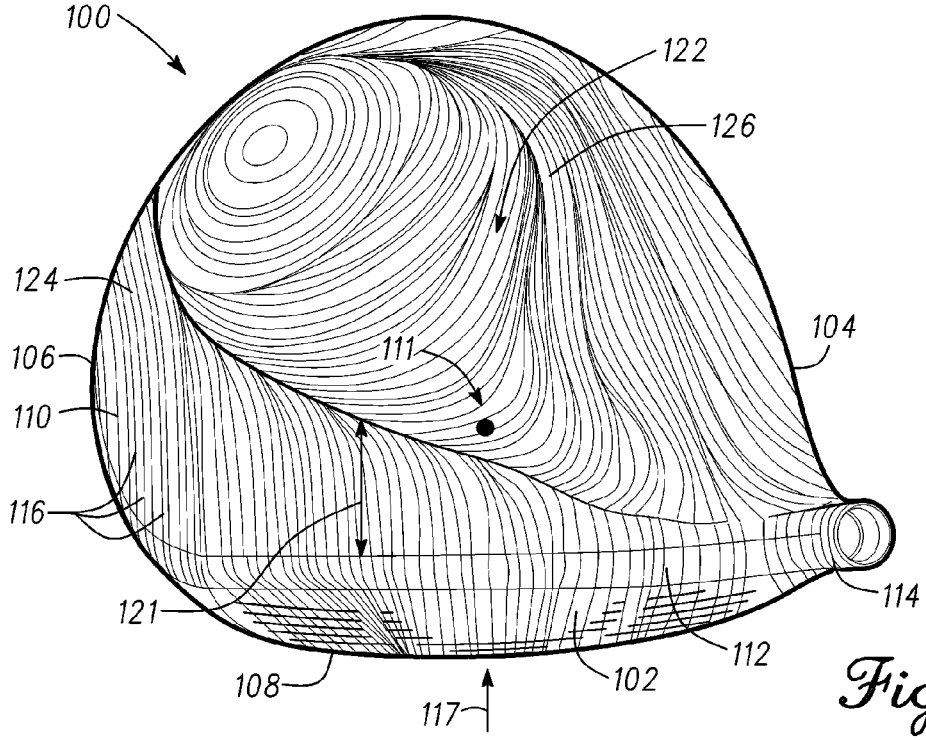
FIG. 1 is a top perspective view of a club head showing air flow streamlines on the club head.

Referring to FIG. 1, a golf club head 100 is shown, which includes a face 102 that extends horizontally from a heel end 104 to a toe end 106 and vertically from a sole 108 to a crown 110. A transition region between the face 102 and the crown 110 defines a leading edge 112. The highest point on the crown 110 defines an apex 111. The club head 100 also includes a hosel 114 for receiving a shaft (not shown). The club head 100 is a wood-type club head. However, the present disclosure is not limited to wood-type club heads and applies to any type of golf club head (e.g., a driver-type club head, a fairway wood-type club head, a hybrid-type club head, an iron-type club head, a wedge-type club head, or a putter-type club head). The apparatus, methods, and articles of manufacture described herein are not limited in this regard.

FIG. 1 shows an exemplary air flow pattern on the club head 100 with streamlines 116. Air flowing in the direction of the arrow 117 flows over the crown 110 from the leading edge 112 toward the rear section of the crown 110. The airflow may remain attached to the crown 110 from the leading edge 112 to a separation region 120 located at a certain separation distance 121 from the leading edge 112. The separation may occur in a narrow strip on the crown 110, hence the separation region 120 may also be referred to herein as a separation line 120. As shown in FIG. 1, the distance 121 may vary from the heel end 104 to the toe end 106 depending on the physical characteristics of the club head 100. At the separation region 120, the airflow detaches from the crown 110 and creates a wake region 122, which is defined by the airflow becoming turbulent or forming eddies and vortices in the free stream region. The pressure differential between the wake region 122 and the attached flow region on the crown 110 creates a pressure drag on the club head 100. The pressure drag reduces the speed of the club head 100, hence affecting the speed by which a ball is hit with the club head 100. To maintain the air flow attached on the crown 110 for a longer distance 121, the air flow in the boundary layer before the separation region 120 can be energized to delay air flow detachment or to move the separation region 120 farther back on the crown 110. To energize the boundary layer, which may be laminar upstream of the separation region 120, the boundary layer can be made turbulent (or more turbulent if the flow is turbulent) upstream of the separation region 120.

Figure 2:
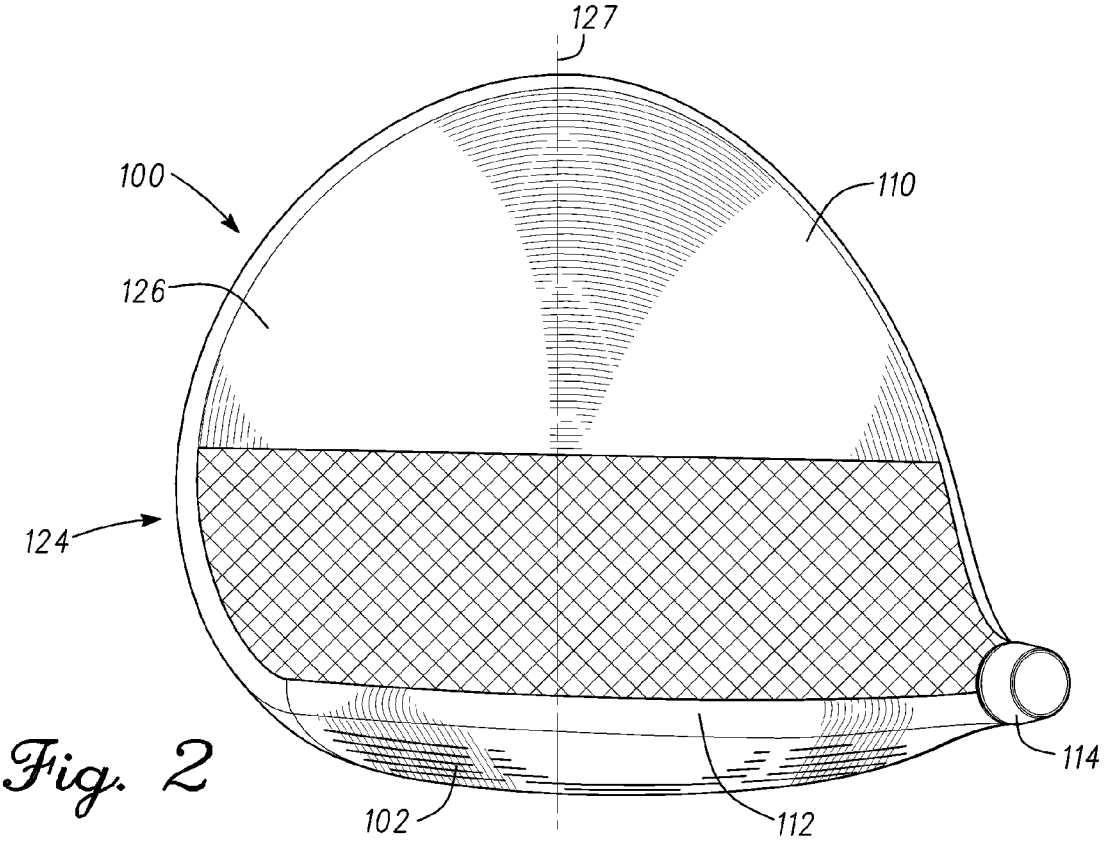
FIG. 2 is a top perspective view of a club head shown front and aft regions of a crown of the club head.
Figure 3:
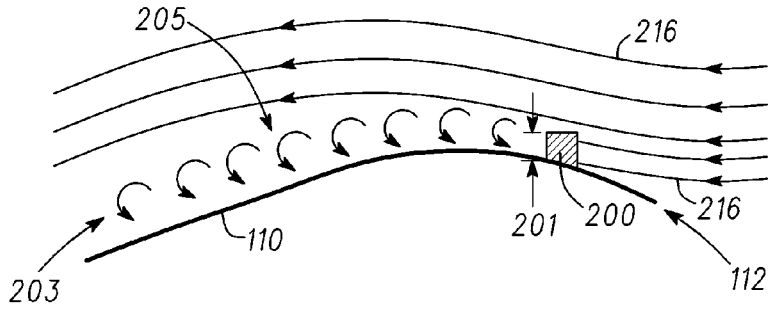
FIG. 3 is a schematic cross-sectional diagram of a turbulator according to one embodiment.

To delay air flow separation or detachment as described above, the golf club head 100 includes turbulators positioned on the crown 110 as described in detail below. Referring to FIG. 2, the turbulators may be positioned in the front region 124 of the crown 110 and before the separation region 120 to delay air flow separation or move the separation region 120 toward the rear region 126 of the crown 110. A schematic diagram of an exemplary turbulator 200 is shown in cross section in FIG. 3. The turbulator 200 projects upward from the crown 110 at a height 201 such that it is inside the boundary layer 203. The turbulator 200 trips the air flowing over the crown 110 as shown by the streamline 216 to create turbulence 205 inside the boundary layer 203. The turbulence energizes the boundary layer 203 to delay separation of the air flow on the crown 110 and move the separation region 120 toward the aft region 126 of the crown 110. In other words, the turbulators according to the disclosure increase the distance 121 shown in FIG. 1.

Figure 4:
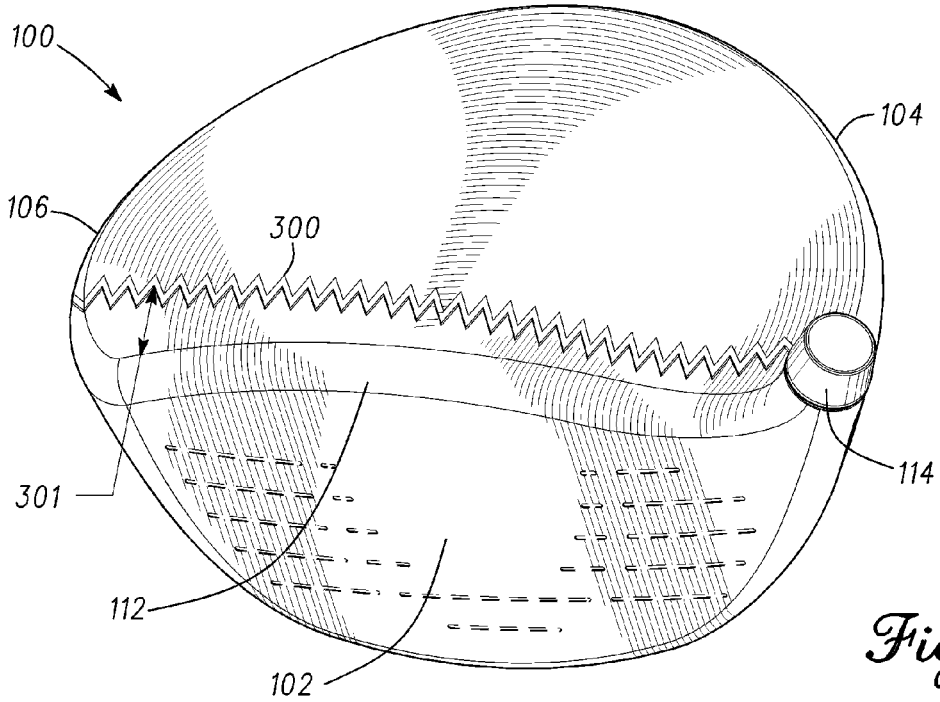
FIG. 4 is a perspective view of a club head having a turbulator according to one embodiment.

An example of a turbulator 300 is shown in FIG. 4. The turbulator 300 energizes the boundary layer on the crown 110 by generating turbulence in the boundary layer. The turbulator 300 is located on the crown 110 at a constant or variable distance 301 downstream of the leading edge 112 and may extend from the hosel 114 or the heel end 104 to the toe and 106. The turbulator 300 provides a plurality of projected surfaces in discrete or continuous form on the surface of the crown 110 at a height (not showing FIGS. 4-8, but generally shown with reference number 201 in FIG. 3). When the air flowing over the crown 110 encounters the projected surfaces of the turbulator 300, the air trips and becomes turbulent inside the boundary layer to energize the boundary layer.

Figure 5:
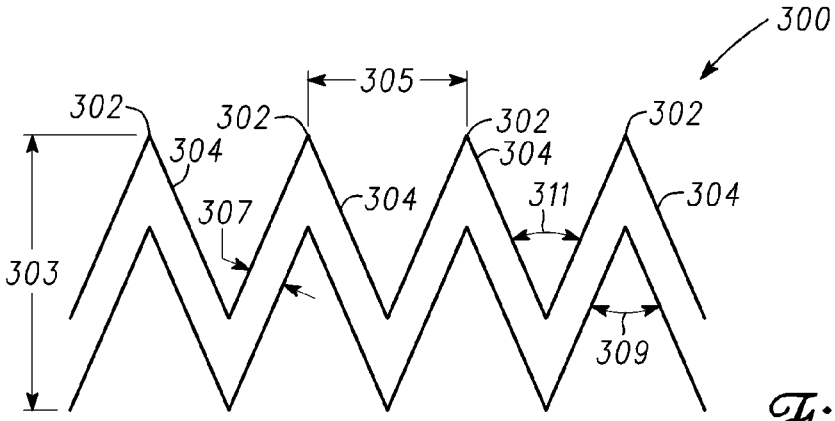
FIG. 5 is a schematic diagram of the turbulator of FIG. 4.
Figure 6:
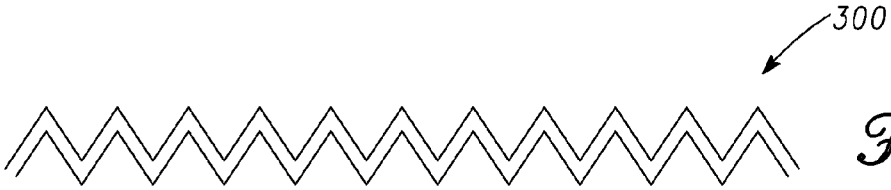
FIGS. 6-8 show examples of different turbulators according to the embodiment of FIG. 4.
Figure 7:
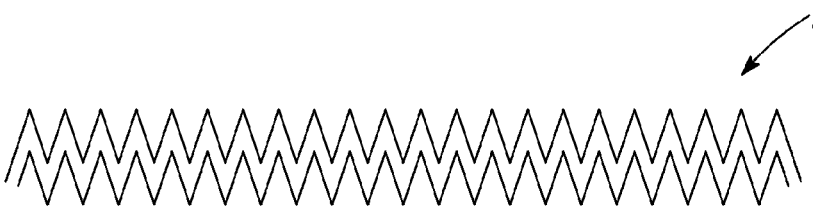
Figure 8:
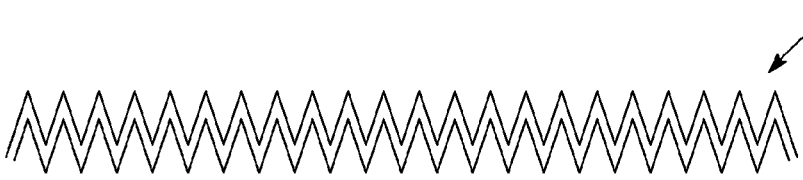

The turbulator 300 shown in the example of FIG. 4 is formed by a strip having a zigzag pattern. Referring to FIG. 5, the zigzag pattern provides peaks 302 and swept back surfaces 304. The peaks 302 and the swept back surfaces 304 provide continuous tripping of the air flow across the width 303 of the turbulator 300. The peaks 302 are spaced apart by a distance 305 and the turbulator 300 has a thickness 307, a height (not shown in FIGS. 4-8), and surface characteristics that may affect air flow. The peaks 302 are defined by a peak angle 309 and the angle between two adjacent peaks 302 is defined by a valley angle 311. Referring to FIGS. 6-8, the width 303, the distance 305, the thickness 307, the height and/or the angles 309 and 311 may be different for each application to provide a particular flow pattern over the crown 110. The surface characteristics of the turbulator 300 may also vary to provide a certain flow pattern over the crown 110. The surface characteristics of the turbulator 300 may refer to the roughness or smoothness of the top surface of the turbulator 300. In the examples of FIGS. 6-8, the turbulator 300 shown in FIG. 7 may provide greater turbulence in a boundary layer than the turbulator 300 of FIG. 6. Accordingly, the turbulator 300 of FIG. 7 may be suitable in a certain application depending on the physical characteristics of the club head 100. However, the turbulator 300 of FIG. 6 may be suitable for another type of club head 100. Accordingly, each of the exemplary turbulators 300 of FIGS. 6-8 may be suitable for different club heads 100.

The turbulator 300, for example, may have a height that does not exceed 0.5 inches (1.27 cm). In one embodiment, the turbulator 300 may have a height that is greater than 0.02 inches (0.05 cm) but less than 0.2 inches (0.51 cm). In one embodiment, the width 303 of the turbulator may be less than 0.75 inches (1.91 cm). The turbulator 300 may have a peak-to-peak distance 305 that contributes to the delay in airflow separation. The location of the turbulator 300 may vary depending on the physical characteristics of the club head 100 and the flow pattern on the crown 110. The turbulator 300 may be located on the crown 110 at an oblique angle relative to the club face 102 as shown in FIG. 4, or be parallel to the club face 102 between 0.25 inches (0.64 cm) and 4.5 inches (11.43 cm) from the club face 102. The turbulator 300 may be located in a curvilinear manner on the crown 110 based on the separation region 120 of a particular club head 100. In one embodiment, the turbulator 300 is located between the club face 102 and the apex 111 of the crown 110. Accordingly, the turbulator 300 may be located between the leading edge 112 and the apex 111 of the crown 110. The turbulator 300 may be located on the crown 110 such that the swept back surfaces 304 form an angle of between 20° and 70° degrees relative to the centerline 127 (shown in FIG. 2) of the club head 100.

Referring to FIG. 4, for example, the turbulator 300 may be a strip that extends from the heel end 104 to the toe end 106. Additionally, the distance 301 increases from the heel end 104 to the toe end 106. This increase in the distance 301 positions the turbulator to approximately follow the shape of the separation region 120 shown in FIG. 1. Alternatively, the turbulator 300 may be a curved strip (not shown) that substantially follows the shape of the separation region 120.

The width 303, the distance 305, the thickness 307, the height and/or the angles 309 and 311 may be constant along the length of the turbulator as shown in FIGS. 6-8. However, any one or all of noted parameters may vary along the turbulator 300 from the heel end 104 to the toe end 106 to provide a particular airflow effect. Furthermore, the surface characteristics of the turbulator 300 may be constant or vary along the turbulator 300 from the heel end 104 to the toe end 106. The turbulator 300 may have any pattern similar to the zigzag pattern described above or other patterns that can provide the boundary layer energizing function described above. Such patterns may include various geometric shapes such as square, rectangular, triangular, curved, circular, polygonal or other shapes in discrete or continuous configurations. The apparatus, methods, and articles of manufacture described herein are not limited in this regard.

The turbulator 300 is shown to be a continuous strip in FIG. 4. However, the turbulator 300 may be formed by a plurality of turbulator segments that are positioned on the crown 110 in different configurations relative to each other such as aligned, offset and/or tandem. For example, the turbulator 300 may include three discrete zigzag strips that are positioned at different distances 301 on the crown 110. Each of the discrete strips may have similar or different properties, such as similar or different height, width 303, the distance 305, the thickness 307, the angles 309 and/or 311.

The turbulator 300 may be constructed from any type of material, such as stainless steel, aluminum, titanium, various other metals or metal alloys, composite materials, natural materials such as wood or stone or artificial materials such as plastic. If the turbulator 300 is constructed from metal, it may be formed on the club head 100 or simultaneously with the club head 100 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 100 and/or the turbulator 300. Molten metal or plastic material is injected into the mold, which is then cooled. The club head 100 and/or the turbulator 300 is then removed from the mold and may be machined to smooth out irregularities on the surfaces thereof or to remove residual parts. If the turbulator 300 is manufactured separately from the club head 100, the turbulator 300 can be fixedly or removably attached to the crown 110 with fasteners, adhesive, welding, soldering, or other fastening methods and/or devices. In one example, the turbulator 300 may be formed from a strip of material having an adhesive backing. Accordingly, the turbulator 300 may be attached to the club head 100 at any location on the crown with the adhesive backing.

Figure 9:
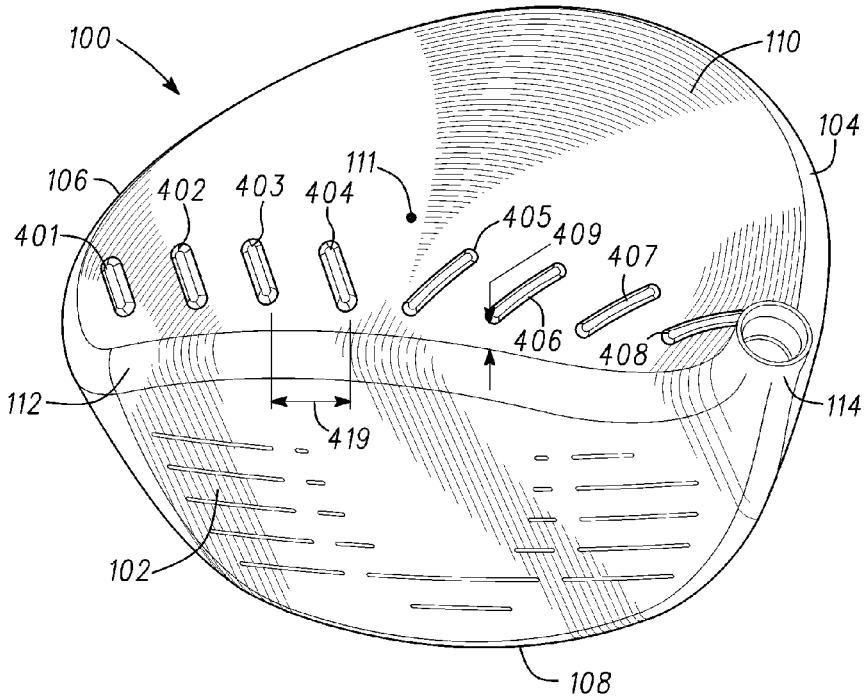
FIGS. 9 and 10 are perspective views of a club head having a turbulator according to one embodiment.
Figure 10:
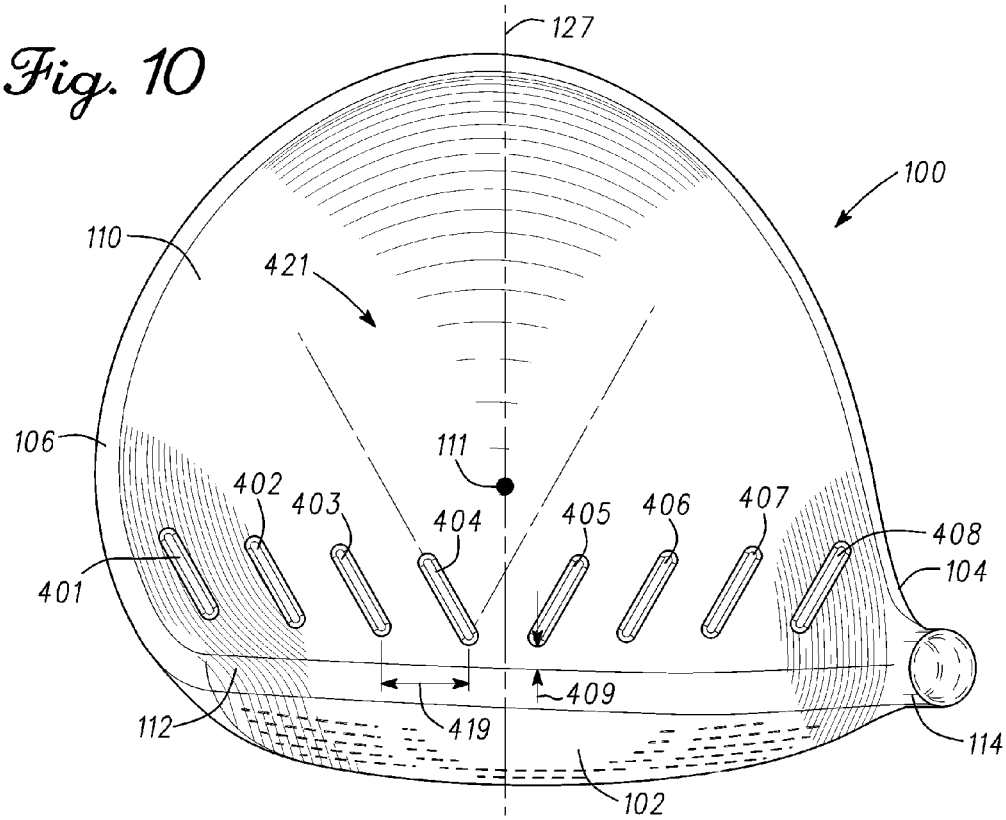

Referring to FIGS. 9 and 10, another exemplary turbulator 400 is shown. The turbulator 400 includes a plurality of ridges 401-408 that are positioned downstream of the leading edge 112 and at least partly before the separation region 120. Each ridge 401-408 may be spaced from the leading edge 112 at the same distance 409 as another ridge or a different distance 409 than another ridge. While FIGS. 9 and 10 may depict a particular number of ridges, the apparatus, methods, and articles of manufacture described herein may include more or less number of ridges. Referring to FIGS. 11-14, in which examples of only the ridge 404 are shown, each ridge 401-408 has a length 411, a base width 413, a height 415 (shown in FIG. 12) and an angle 417 relative to the leading edge 112 of the club head 100. Each ridge 401-408 may be spaced apart from an adjacent ridge by a distance 419 (shown in FIGS. 9 and 10), which is measured from the leading edges 410 of the ridges 401-408 if the ridges are not parallel.

Figure 11:
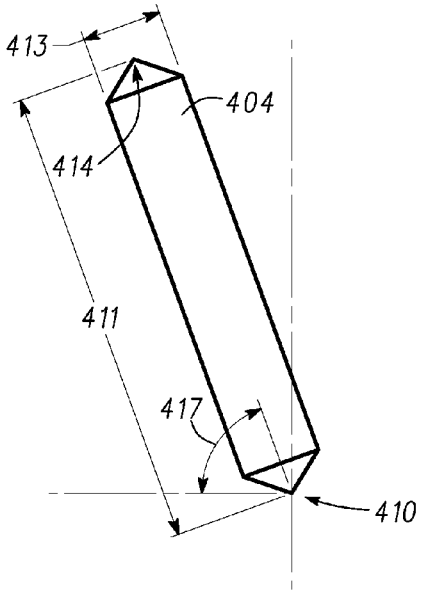
FIG. 11 is a schematic diagram of a section of the turbulator of FIGS. 9 and 10.
Figure 12:
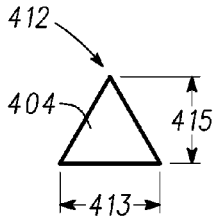
FIGS. 12-14 show different cross-sectional diagrams of turbulators according to the embodiment of FIGS. 9 and 10.
Figure 13:
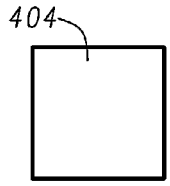
Figure 14:
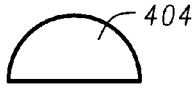

FIG. 11 illustrates an exemplary shape for the ridge 404 and does not in any way limit the shape of the ridges 401-408. The ridges 401-408 may have any cross-sectional shape. In FIGS. 12-14, three exemplary cross-sectional shapes for the ridges 401-408 are shown. The length 411 may be substantially greater than the base width 413. The ridges 401-408 function as vortex generators to energize the boundary layer that forms on the crown 110, hence moving the separation region 120 further aft on the crown 110. Thus, each ridge 401-408 functions as a turbulator. The height 415 of each ridge 401-408 may be such that the top 412 (shown in FIG. 12) of each ridge 402 remains inside the boundary layer. However, any one or more of the ridges may extend above the boundary layer.

The angle 417 for each ridge may be configured so that each ridge 401-408 is oriented generally perpendicular, parallel or oblique relative to the leading edge 112 and/or relative to each other. In one embodiment, the angle 417 may be between 20° and 70°. In the example of FIGS. 9 and 10, the turbulator 400 includes four ridges 401-404 on the toe end side of the club head 100 that are oriented generally at an angle 417 of about 60°-70° and parallel to each other. The turbulator 400 also includes four ridges 405-408 that are symmetric with respect to the angle 417 about a centerline 127 of the club head 100 relative to the ridges 401-404.

Each ridge 401-408 is shown to be a linear. However, each of the ridges 401-408 can be curved, have variable base width 413 along the length 411, have variable cross-sectional shapes, have variable height 415 along the length 411 and/or the base width 413, have sharp or blunt leading edges 410 or trailing edges 414, have sharp or blunt tops 412; have different surface textures, and/or have other physical variations along the length 411, the base width 413 and/or the height 415. The distance 409 may increase for each ridge 401-408 from the heel end 104 to the toe end 106 to approximately correspond with the location of the separation line 120 on the crown 110. However, as shown in FIGS. 9 and 10, each ridge 401-408 may be located on the crown 110 at substantially the same distance 409 from the leading edge 112. Furthermore, each of the ridges 401-408 may be placed anywhere on the crown 110 to provide the boundary layer effects described herein. The location of the ridges may vary depending on the physical characteristics of the club head 100 and the airflow pattern on the crown 110. Each of the ridges 401-408 may be located along a straight line or a curvilinear line on the crown 110 between 0.25 inches (0.64 cm) and 4.5 inches (11.43 cm) from the club face 110. Each ridge 401-408 may have a height 415 that does not exceed 0.5 inches (1.27 cm). In one embodiment, at least one ridge 401-408 may have a height 415 that is greater than 0.02 inches (0.05 cm) but less than 0.2 inches (0.51 cm). The ridges 401-408 may have a distance 419 that contributes to the delay in airflow separation. The ridges 401-408 may be arranged on the crown 110 in a curvilinear manner based on the location of the separation region 120 of a particular club head 100. In one embodiment, the ridges 401-408 are located between the face 102 and the apex 111 of the crown 110. Accordingly, the ridges 402 may be located between the leading edge 112 and the apex 111 of the crown 110.

Referring to FIG. 10, each ridge 401-408 trips the air flowing over the ridge to create small eddies or vortices along the length 411 for energizing the boundary layer downstream of the ridge 401-408 in an area 421 (shown only on ridge 404). Accordingly, the separation region 120 is moved farther aft on the crown 110. The distance 419 between each ridge 401-408, length 411, base width 413, height 415 and/or angle 417 may be configured so that the areas 421 slightly or greatly overlap, or do not overlap. As shown in the example of FIG. 10, the distance 419, the length 411 and the angle 417 of each ridge 401-408 are configured such that the leading edge 410 of each ridge 401-408 is generally aligned along the direction of airflow with the trailing edge 414 of an adjacent ridge 401-408. Thus, the arrangement of the ridges 401-408 on the crown 110 as shown in of FIGS. 9 and 10 provides overlapping areas 421 of boundary layer turbulence. However, the ridges 401-408 can be configured to have any physical characteristics and spaced apart at any distance 419. For example, if the ridges have shorter lengths than the length 411 of the ridges 401-408 shown in FIGS. 9 and 10, the distance 419 can be reduced to ensure overlap of areas 421 downstream of the ridges 401-408. In another example, if the angles 417 of the ridges 401-408 relative to the club face 100 are different than the angle 417 shown in FIGS. 9 and 10, the distance 419 or the lengths 411 of the ridges 401-408 can be accordingly modified to ensure that areas 421 overlap downstream of the ridges 401-408. In yet another example, multiple rows of ridges can be provided on the crown 110 in tandem or offset relative to each other. Thus, any number of ridges with each ridge having any physical characteristic and distance 409 relative to an adjacent ridge can be provided on the crown 110. For example, in certain application, overlapping of the areas 421 may not be suitable. Accordingly, the ridges 401-408 can be configured to reduce, minimize or prevent overlap of the areas 421.

Referring to FIG. 10, the ridges 401-404 are arranged to point toward the centerline 127, and the ridges 405-408 are also arranged to point toward the centerline 127. Accordingly, the ridges 401-408 can function as an alignment aid for a player to align the club face 102 with a ball. An individual standing in an address position may visually determine the position of the ball (not shown) relative to the centerline 127 with the aid of the ridges 401-408.

Figure 15:
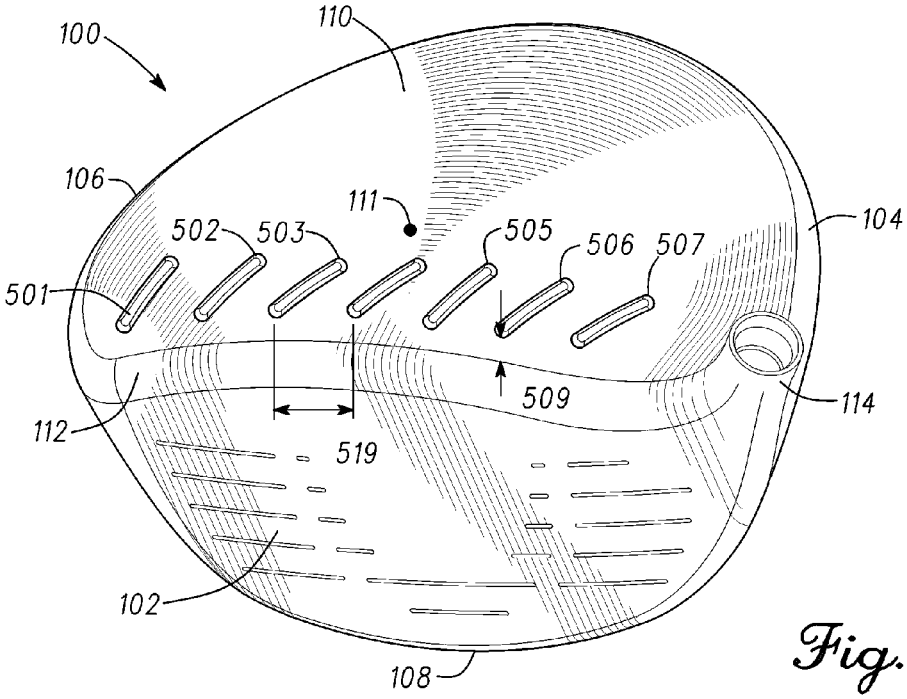
FIGS. 15 and 16 are perspective views of a club head having a turbulator according to one embodiment.
Figure 16:
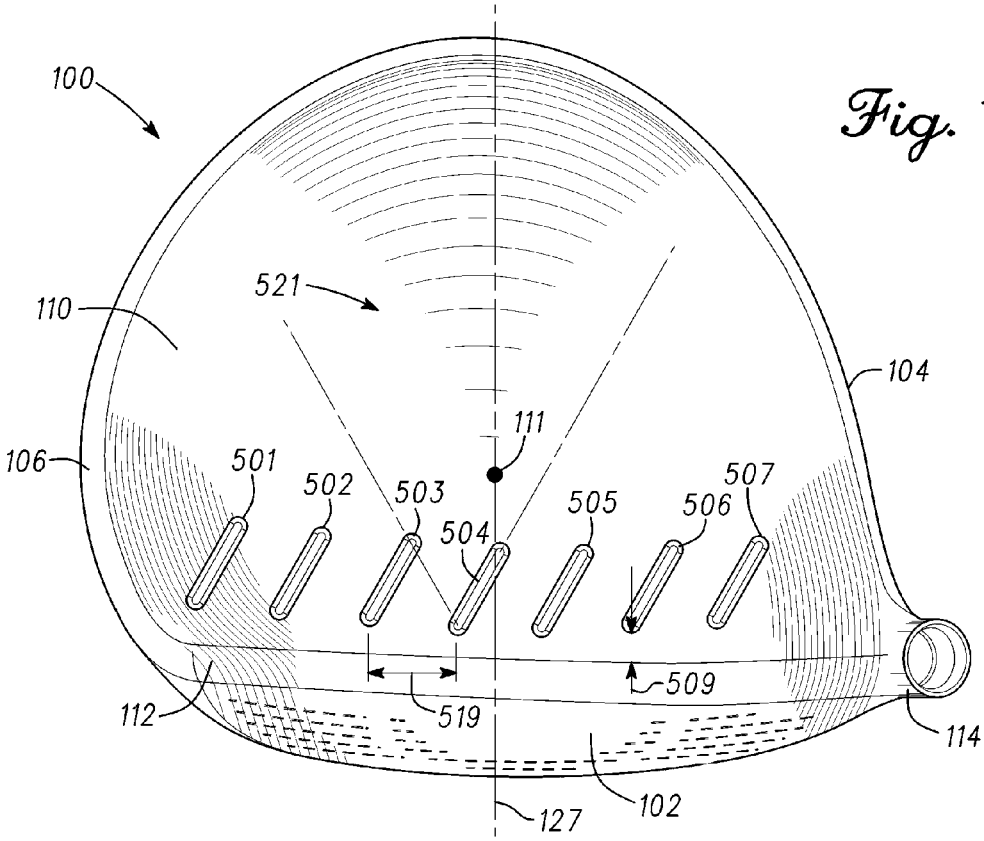

Referring to FIGS. 15 and 16, another exemplary turbulator 500 is shown. The turbulator 500 includes a plurality of ridges 501-507 that are positioned downstream of the leading edge 112 and at least partly before the separation region 120.

Each ridge 501-507 may be spaced from the leading edge 112 at the same distance 509 as another ridge or a different distance 509 than another ridge. While FIGS. 15 and 16 may depict a particular number of ridges, the apparatus, methods and articles of manufacture described herein may include more or less number of ridges. Referring to FIGS. 17-20, in which examples of only the ridge 504 are shown, each ridge 501-507 has a length 511, a base width 513, a height 515 (shown in FIG. 18) and an angle 517 relative to the leading edge 112 of the club head 100. Each of the ridges 501-507 is spaced apart from an adjacent ridge by a distance 519 (shown in FIGS. 15 and 16), which is measured from the leading edges 504 of the ridges 501-507 if the ridges are not parallel.

Figure 17:
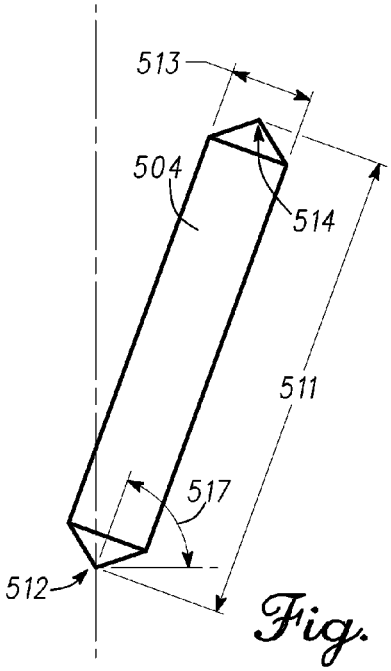
FIG. 17 is a schematic diagram of a section of the turbulator of FIGS. 15 and 16.
Figure 18:
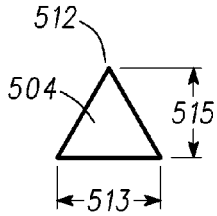
FIGS. 18-20 show different cross-sectional diagrams of turbulators according to the embodiment of FIGS. 15 and 16.
Figure 19:
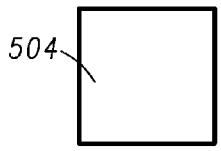
Figure 20:
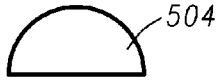

FIG. 17 illustrates an exemplary shape for the ridge 504 and does not in any way limit the shape of the ridges 501-507. The ridges 501-507 may have any cross-sectional shape. In FIGS. 18-20, three exemplary cross-sectional shapes for the ridges 501-507 are shown. The length 511 may be substantially greater than the base width 513. The ridges 501-507 function as vortex generators to energize the boundary layer that forms on the crown 110, hence moving the separation region 120 further aft on the crown 110. Thus, each ridge 501-507 functions as a turbulator. The height 515 of each ridge 501-507 may be such that the top 512 (shown in FIG. 18) of each ridge 501-507 remains inside the boundary layer. However, any one or more of the ridges may extend above the boundary layer.

The angle 517 for each ridge may be configured so that each ridge 501-507 is oriented generally perpendicular, parallel or oblique relative to the leading edge 112 and/or relative to each other. In one embodiment, the angle 517 may be between 20° and 70°. In the example of FIGS. 15 and 16, the turbulator 500 includes seven ridges 501-507 that are oriented generally at an angle 517 of about 60°-70° and parallel to each other.

Each ridge 501-507 is shown to be a linear. However, each of the ridges 501-507 can be curved, have variable base width 513 along the length 511, have variable cross-sectional shapes, have variable height 515 along the length 511 and/or the base width 513, have sharp or blunt leading edges 510 or trailing edges 514, have sharp or blunt tops 512, have different surface textures, and/or have other physical variations along the length 511, the base width 513 and/or the height 515. The distance 509 may increase for each ridge 501-507 from the heel end 104 to the toe end 106 to approximately correspond with the location of the separation line 120 on the crown 110. However, as shown in FIGS. 15 and 16, each ridge 501-507 may be located at substantially the same distance 509 from the leading edge 112. Furthermore, each of the ridges 501-507 may be placed anywhere on the crown 110 to provide the boundary layer effects described herein. The location of the ridges may vary depending on the physical characteristics of the club head 100 and the airflow pattern on the crown 110. Each of the ridges 501-507 may be located along a straight line or a curvilinear line on the crown 110 between 0.25 inches (0.64 cm) and 4.5 inches (11.43 cm) from the club face 110. Each ridge 501-507 may have a height 515 that does not exceed 0.5 inches (1.27 cm). In one embodiment, at least one ridge 501-507 may have a height 515 that is greater than 0.02 inches (0.05 cm) but less than 0.2 inches (0.51 cm). The ridges 501-507 may have a distance 519 that contributes to the delay in airflow separation. The ridges 501-507 may be arranged on the crown 110 in a curvilinear manner based on the location of the separation region 120 of a particular club head 100. In one embodiment, the ridges 501-507 are located prior to the apex 111 of the crown 110. Accordingly, the ridges 501-507 may be located between the leading edge 112 and the apex 111 of the crown 110.

Referring to FIG. 16, each ridge 501-507 trips the air flowing over the ridge to create small eddies or vortices along the length 511 for energizing the boundary layer downstream of the ridge 501-507 in an area 521 (shown only on ridge 504). Accordingly, the separation region 120 is moved farther aft on the crown 110. The distance 519 between each ridge 501-507, length 511, base width 513, height 515 and/or angle 517 may be configured so that the areas 521 slightly or greatly overlap, or do not overlap. As shown in the example of FIG. 16, the distance 519, the length 511 and the angle 517 of each ridge 501-507 are configured such that the leading edge 510 of each ridge 501-507 is generally aligned along the direction of airflow with the trailing edge 514 of an adjacent ridge 501-507. Thus, the arrangement of the ridges 501-507 on the crown 110 as shown in of FIGS. 15 and 16 provides overlapping areas 521 of boundary layer turbulence. However, the ridges 501-507 can be configured to have any physical characteristics and spaced apart at any distance 519. For example, if the ridges have shorter lengths than the length 511 of the ridges 501-507 shown in FIGS. 15 and 16, the distance 519 can be reduced to ensure overlap of areas 521 downstream of the ridges 501-507. In another example, if the angles 517 of the ridges 501-507 relative to the club face 100 are different than the angle 517 shown in FIGS. 15 and 16, the distance 519 or the lengths 511 of the ridges 501-507 can be accordingly modified to ensure that areas 521 overlap downstream of the ridges 501-507. In yet another example, multiple rows of ridges can be provided on the crown 110 in tandem or offset relative to each other. Thus, any number of ridges with each ridge having any physical characteristic and distance 509 relative to an adjacent ridge can be provided on the crown 110. For example, in certain application, overlapping of the areas 521 may not be suitable. Accordingly, the ridges 501-507 can be configured to reduce minimize or prevent overlap of the areas 521.

Referring to FIGS. 21 and 22, another exemplary turbulator 600 is shown. The turbulator 600 includes a plurality of ridges 601-608 that are positioned downstream of the leading edge 112 and at least partly before the separation region 120. Each ridge 601-608 may be spaced from the leading edge 112 at the same distance 609 as another ridge or at a different distance 609 than another ridge. While FIGS. 21 and 22 may depict a particular number of ridges, the apparatus, methods, and articles of manufacture described herein may include more or less number of ridges. Referring to FIGS. 22-26, in which examples of only the ridge 604 are shown, each ridge 601-608 has a length 611, a base width 613, a height 615 (shown in FIG. 24) and an angle 617 relative to leading edge 112 of the club head 100. Each of the ridges 601-608 is spaced apart from an adjacent ridge by either a first peak-to-peak distance 623 or a second peak-to-peak distance 625 (shown in FIGS. 21 and 22), where 623 and 625 are measured from the leading edges 604 of adjacent ridges 601-608.

Figure 23:
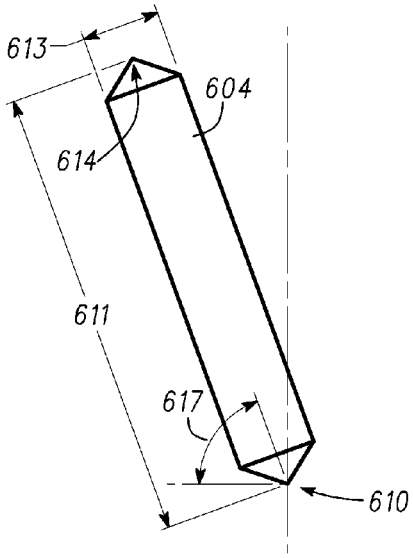
FIG. 23 is a schematic diagram of a section of the turbulator of FIGS. 21 and 22.
Figure 24:
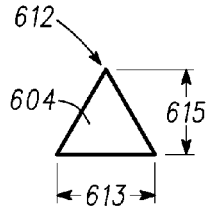
FIGS. 24-26 show different cross-sectional diagrams of turbulators according to the embodiment of FIGS. 21 and 22.
Figure 25:
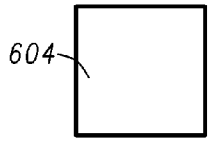
Figure 26:
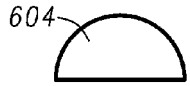

FIG. 23 illustrates an exemplary shape for a ridge 604 and does not in any way limit the shape of the ridges 601-608. The ridges 601-608 may have any cross-sectional shape. In FIGS. 24-26, three exemplary cross-sectional shapes for the ridges 601-608 are shown. The length 611 may be substantially greater than the base width 613. The ridges 601-608 function as vortex generators to energize the boundary layer forming on the crown 110, hence moving the separation region 120 further aft on the crown 110. Thus, each ridge 601-608 functions as a turbulator. The height 615 of each ridge 601-608 may be such that the top 612 (shown in FIG. 24) of each ridge 601-608 remains inside the boundary layer.

The angle 617 for each ridge may be configured so that each ridge 601-608 is oriented generally perpendicular, parallel or oblique relative to the leading edge 112 and/or relative to each other. In one embodiment, the angle 617 may be between 20° and 70° in the absolute value. In the example of FIGS. 21 and 22, the turbulator 600 includes eight ridges 601-608. The ridges 601, 603, 605 and 607 are oriented generally at an angle 617 of about −60° to −70° (see FIG. 17 for a positive angle of a ridge) and parallel to each other. The turbulator 600 also includes four ridges 602, 604, 606 and 608 that are oriented at an angle 617 of about 60° to 70°. Thus, each pair of adjacent ridges 601 and 602; 603 and 604; 605 and 606; and 606 and 608 is configured to resemble a V shape, a triangle or a similar shape.

The ridges 604 and 605 symmetrically straddle the centerline 127 and generally point toward the centerline 127. Accordingly, the ridges 604 and 605 can function as an alignment device to assist a player in generally aligning the ball with the centerline 127.

Each ridge 601-608 is shown to be a linear. However, each of the ridges 601-608 can be curved, have variable base width 613 along the length 611, have variable cross-sectional shapes, have variable height 615 along the length 611 and/or the base width 613, have sharp or blunt leading edges 610 or trailing edges 614, have sharp or blunt tops 612, have different surface textures, and/or have other physical variations along the length 611, the base width 613 and/or the height 615. The distance 609 may increase for each ridge 601-608 from the heel end 104 to the toe end 106 to approximately correspond with the location of the separation line 120 on the crown 110. However, as shown in FIGS. 21 and 22, each ridge 601-608 may be located at substantially the same distance 609 from the leading edge 112. Furthermore, each of the ridges 601-608 may be placed anywhere on the crown 110 to provide the boundary layer effects described herein. The location of the ridges may vary depending on the physical characteristics of the club head 100 and the airflow pattern on the crown 110. Each of the ridges 601-608 may be located along a straight line or a curvilinear line on the crown 110 between 0.25 inches (0.64 cm) and 4.5 inches (11.43 cm) from the club face 110. Each ridge 601-608 may have a height 615 that does not exceed 0.5 inches (1.27 cm). In one embodiment, at least one ridge 601-608 may have a height 615 that is greater than 0.02 inches (0.05 cm) but less than 0.2 inches (0.51 cm). The ridges 601-608 may have a distance 623 or 625 that contributes to the delay in airflow separation. The ridges 601-608 may be arranged on the crown 110 in a curvilinear manner based on the location of the separation region 120 of a particular club head 100. In one embodiment, the ridges 601-608 are located prior to the apex 111 of the crown 110 (highest point on the crown). Accordingly, the ridges 601-608 may be located between the leading edge 112 and the apex 111 of the crown 110.

Referring to FIG. 22, each ridge 601-608 trips the air flowing over the ridge to create small eddies or vortices along the length 611 for energizing the boundary layer downstream of the ridge 601-608 in an area 621 (shown only on ridge 604). Accordingly, the separation region 120 is moved farther aft on the crown 110. The distance 623 or 625 between each ridge 601-608, length 611, base width 613, height 615 and/or angle 617 may be configured so that the areas 621 slightly or greatly overlap, or do not overlap. The arrangement of the ridges 601-608 on the crown 110 as shown in of FIGS. 21 and 22 provides overlapping areas 621 of boundary layer turbulence. However, the ridges 601-608 can be configured to have any physical characteristics and spaced apart at any distance 623 or 625. For example, if the ridges have shorter lengths than the length 611 of the ridges 601-608 shown in FIGS. 21 and 22, the distance 623 or 625 can be reduced to ensure overlap of areas 621 downstream of the ridges 601-608. In another example, if the angles 617 of the ridges 601-608 relative to the club face 100 are different than the angle 617 shown in FIGS. 21 and 22, the distance 623 or 625 or the lengths 611 of the ridges 601-608 can be accordingly modified to ensure that areas 621 overlap downstream of the ridges 601-608. In yet another example, multiple rows of ridges can be provided on the crown 110 in tandem or offset relative to each other. Thus, any number of ridges with each ridge having any physical characteristic and distance 609 relative to an adjacent ridge can be provided on the crown 110. For example, in certain application, overlapping of the areas 621 may not be suitable. Accordingly, the ridges 601-608 can be configured to reduce minimize or prevent overlap of the areas 621.

The turbulator 400, 500 or 600 may be constructed from any type of material, such as stainless steel, aluminum, titanium, various other metals or metal alloys, composite materials, natural materials such as wood or stone or artificial materials such as plastic. If the turbulator 400, 500 or 600 is constructed from metal, it may be formed on the club head 100 or simultaneously with the club head 100 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 100 and/or the turbulator 400, 500 or 600. Molten metal or plastic material is injected into the mold, which is then cooled. The club head 100 and/or the turbulator 400, 500 or 600 is then removed from the mold and may be machined to smooth out irregularities on the surfaces thereof or to remove residual parts. If the turbulator 400, 500 or 600 is manufactured separate from the club head 100, the turbulator 400, 500 or 600 can be fixedly or removably attached to the crown 110 with fasteners, adhesive, welding, soldering, or other fastening methods and/or devices. In one example, the turbulator 400, 500 or 600 may be formed from metallic material. The turbulator 400, 500 or 600 can then be attached to the crown 110 with an adhesive. In another example, the turbulator 400 may include an elongated projection that slides into a correspondingly sized slot on the crown 110 to removably attached the turbulator 400, 500 or 600 to the crown 110. Thus, the turbulators 400, 500 or 600 may include removable connection mechanisms so that each turbulator 400, 500 or 600 can be selectively connected to or removed from the club head 100. The turbulators on the crown 110 are described above to be defined by ridges. However, any one or more of the turbulators may be defined by grooves formed in the crown 110. The turbulators may be formed by cutting grooves in the crown 110 by various methods such machining, laser cutting, or the like.

Figure 27:
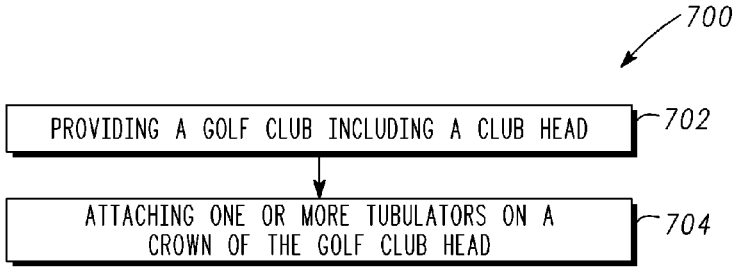
FIG. 27 is a flow chart showing a method of manufacturing a club head with turbulators according to one embodiment.
Figure 28:
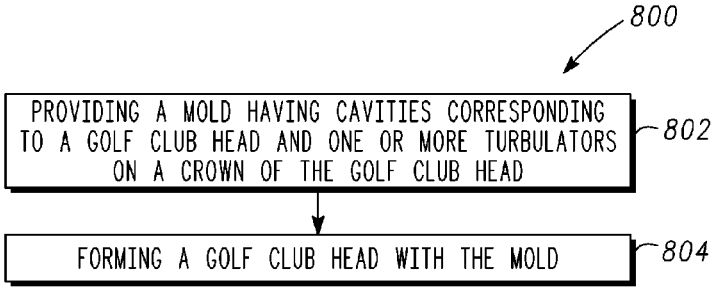
FIG. 28 is a flow chart showing a method of manufacturing a club head with turbulators according to another embodiment.

According to one example shown in FIG. 27, a method 700 of manufacturing a golf club head having turbulators according to various embodiments includes at 702 providing a golf club having a club head, and at 704, attaching one or more turbulators on a crown of the club head. According to another example shown in FIG. 28, a method 800 of manufacturing a golf club head having turbulators according to various embodiments includes at 802 providing a mold having cavities corresponding to a golf club head and one or more turbulators, and at 804, forming the club head and the turbulators with the mold.

Figure 29:
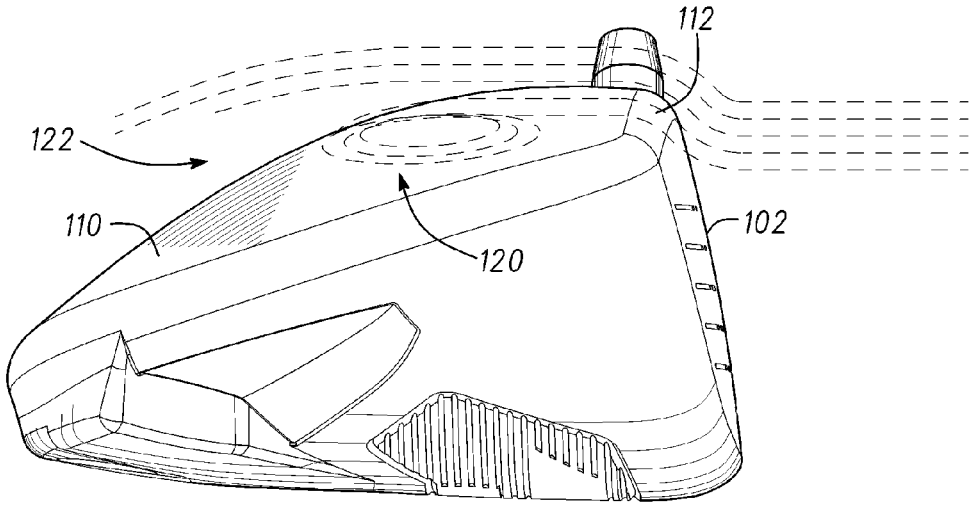
FIG. 29 shows a schematic view based on actual airflow visualization experiments of airflow over a club head without turbulators.
Figure 30:
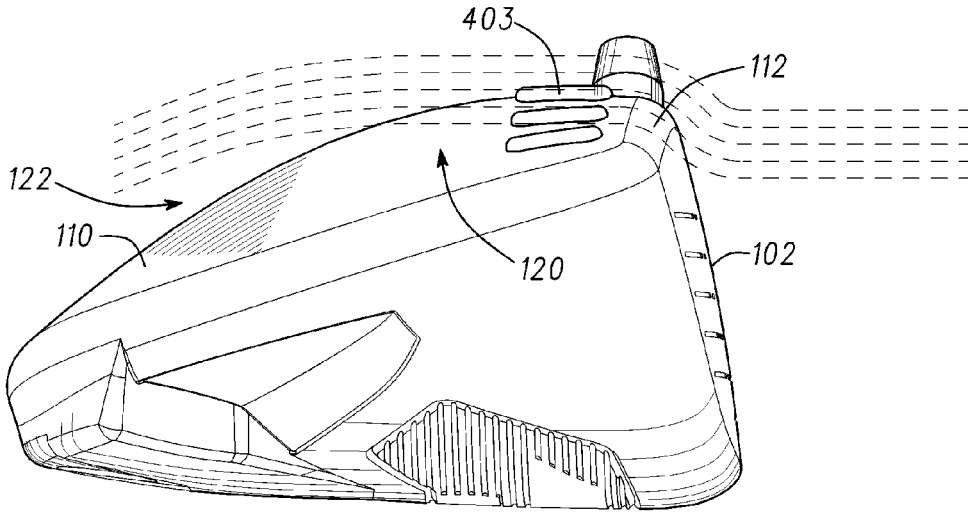
FIG. 30 shows a schematic view based on actual airflow visualization experiments of airflow over the club head of FIG. 29 with turbulators.

FIG. 29 shows a schematic view based on actual airflow visualization experiments of airflow over the club head 100 without turbulators, and FIG. 30 shows a schematic view based on actual airflow visualization experiments of airflow over the same club head with the turbulators 400. In FIG. 29, the streamlines representing airflow approach the club had 100 and are diverted over the club face toward the leading edge. The streamlines traverse over the leading edge 112 and flow over the crown 110. However, the airflow becomes detached from the crown 110 at the separation region 120, and creates a turbulent wake 122 over a substantial section of the crown 110. This turbulent wake 122 increases the drag thereby reducing the speed of the club head 100. Referring to FIG. 30, the ridges 401-408 are positioned downstream of the leading edge 112 and upstream of the separation region 120 of FIG. 29. Accordingly, the flow remains attached on a substantial portion of the crown 110 as is shown by the streamlines in FIG. 30. Therefore, the separation region 120 is moved farther aft on the crown 110.

As described above, any of the physical characteristics of the turbulators 400, 500 or 600; the locations thereof on the crown; and/or the orientations thereof relative to any part of the crown, the centerline 127 and/or the leading edge 112 may be configured to provide a particular boundary layer effect. According to one embodiment, the turbulators may be located a distance Q from the leading edge 112 according to the following relation:

$$Q>0.05DA$$

where DA is the distance from the leading edge 112 to the apex 111 of the crown (i.e., the highest point on the crown). According to another embodiment, the angle γ, which is the angle of each ridge relative to the leading edge 112 may follow the relation:

$$\gamma>\text{Loft}$$

where Loft is the loft angle of the club head 100. According to another embodiment, the distance P, which is the distance between each ridge, may follow the relation:

$$2L\cos(\gamma)>P>0.8L\cos(\gamma)$$

where L is the length of a ridge.

Tables 1 and 2 show experimental results for a golf club head 100 without any turbulators, with the turbulator 300, and with turbulators 400. Table 1 shows measured values of aerodynamic drag expressed in lbs for different orientation angles of the club head 100. The speed of the club head 100 is directly affected by the orientation angle. An increase in orientation angle results in an increase in the speed of the club head 100.

TABLE 1

Drag Force (lbs) vs. Orientation Angle (degrees)

| Angle (in degrees) | Without turbulators | Turbulator 300 | Turbulator 400 |
|---|---|---|---|
| 90 | 2.01496256 | 1.507344 | 1.495429 |
| 60 | 1.30344225 | 1.300062 | 1.293326 |
| 30 | 0.88754571 | 0.905306 | 0.898112 |
| 0 | 0.22323528 | 0.227507 | 0.235375 |

TABLE 2

Lift Force (lbs) vs. Orientation Angle (degrees)

| Angle (in degrees) | Without turbulators | Turbulator 300 | Turbulator 400 |
|---|---|---|---|
| 90 | −0.3884699 | 0.061148 | 0.092846 |
| 60 | 0.27763904 | 0.343283 | 0.189739 |
| 30 | 0.6006895 | 0.608558 | 0.560674 |
| 0 | 0.20772346 | 0.205925 | 0.225259 |

Figure 31:
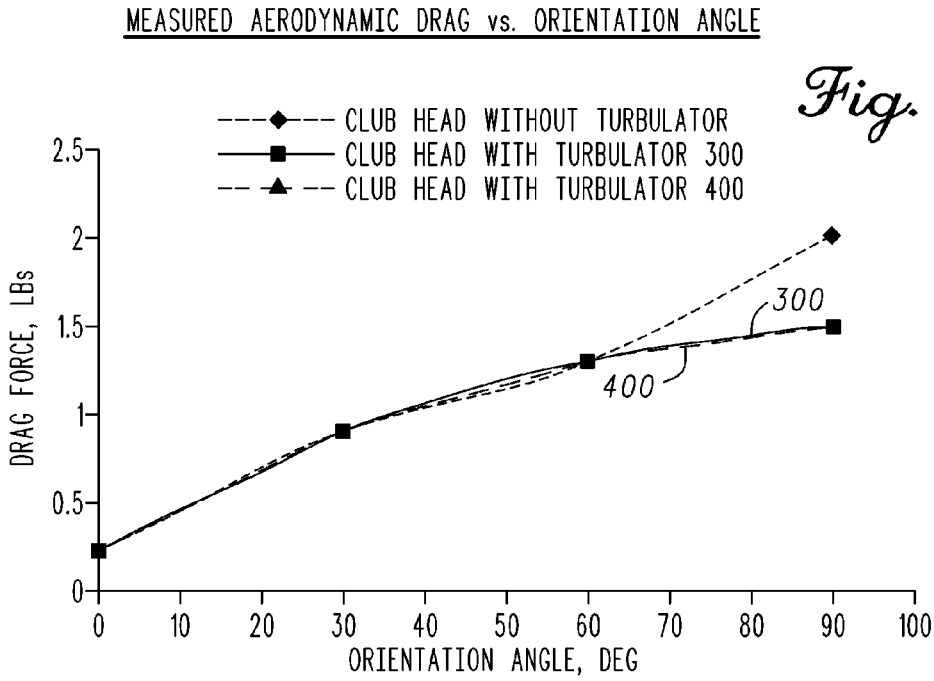
FIG. 31 is a graph showing measurements of drag force vs. orientation angle.

As shown in Table 1, when the club head 100 has an orientation angle of greater than 60°, the aerodynamic drag force on the club head 100 is reduced for the club head 100 having the turbulator 300 or the turbulators 400. The reduction in drag is much greater for an orientation angle of 90°. Referring to FIG. 31, which is a graphical representation of the data in Table 1, the noted reduction in drag for orientation angles of greater than 60° is visually shown. Furthermore, the turbulator 400 (including one or more ridges 401-408) is shown to reduce the drag force on the club head 100 more than the turbulator 300.

Figure 32:
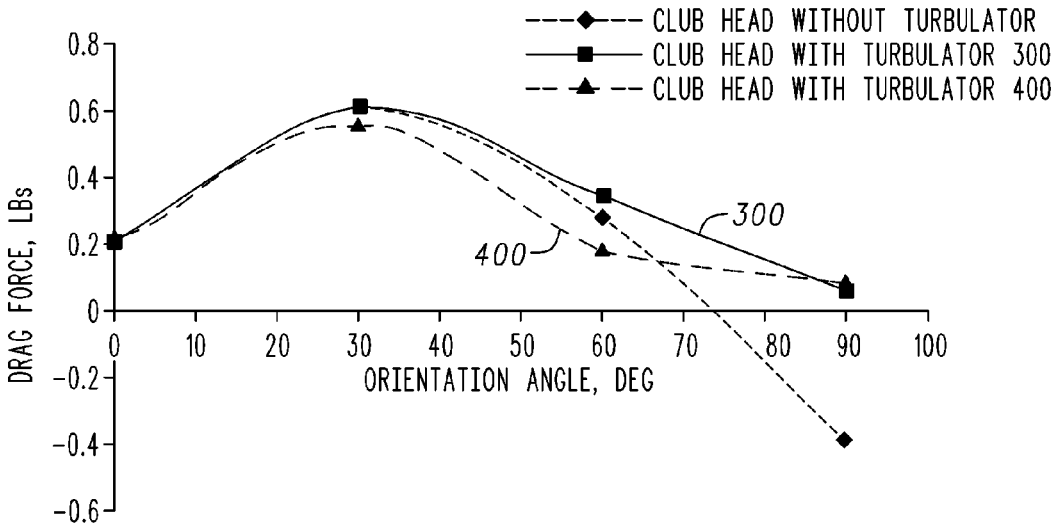
FIG. 32 is a graph showing measurements of lift force vs. orientation angle.

Table 2 shows measured values of lift expressed in lbs for different orientation angles of the club head. When the club head 100 has an orientation angle of greater than 60°, the lift generated by the club head does not drop as sharply for the club head 100 having the turbulator 300 or the turbulators 400 as compared to the club head 100 without any turbulators. Referring to FIG. 32, which is a graphical representation of the data in Table 2, the noted drop in lift for the club head 100 without any turbulators is visually shown. The noted drop in lift is due to the higher pressure differential caused by the earlier boundary layer separation on the crown for the club head 100 without any turbulators as compared to the club head 100 having turbulator 300 or turbulators 400. Thus, Tables 1 and 2 and FIGS. 31 and 32 illustrate the adverse effects of early boundary layer separation on the crown for a golf club head without any turbulators and the effects of delaying the boundary layer separation on drag forces exerted on a golf club head.

Figure 33:
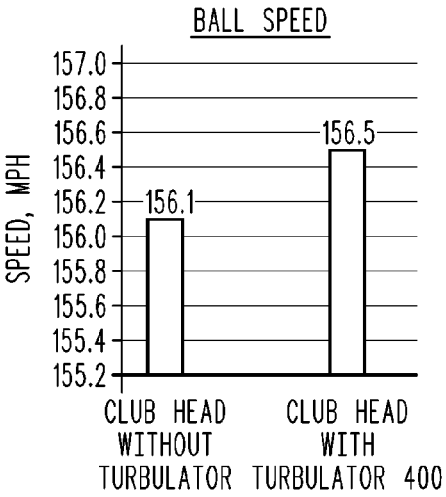
FIG. 33 is a graph showing measurements of ball speed.
Figure 34:
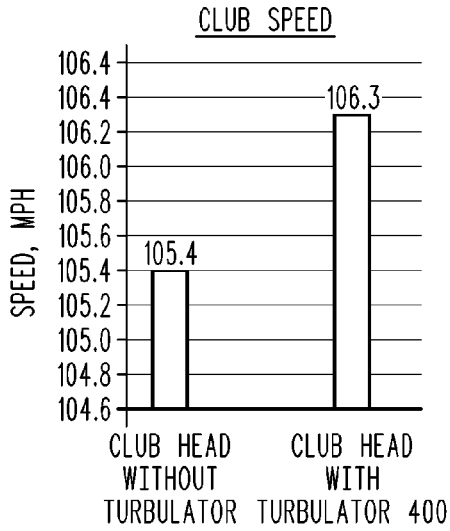
FIG. 34 is a graph showing measurements of club speed.
Figure 35:
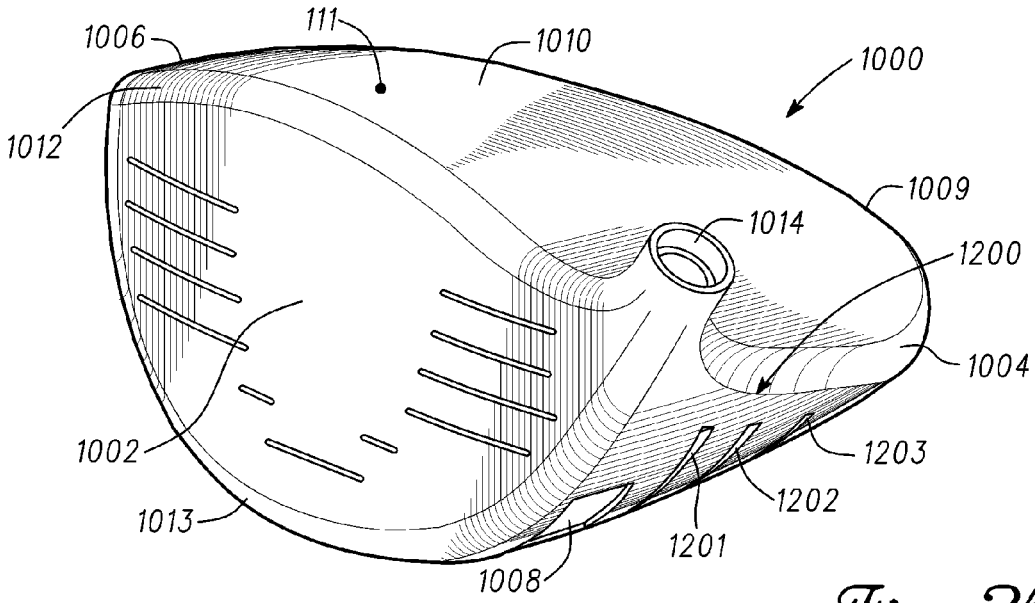
FIGS. 35-38 are different perspective views of a club head having sole turbulators according to one embodiment.

FIGS. 33 and 34 graphically show measured ball speed and club head speed for a golf club head without any turbulators and a golf club head having the turbulators 400. FIG. 33 shows that ball speed is higher when the golf club head includes the turbulators 400. This increase in ball speed is due to the higher club head speed as shown in FIG. 34 due to the turbulators 400 delaying boundary layer separation on the crown, thereby reducing drag forces on the club head.

Referring to FIGS. 35-38, another exemplary golf club head 1000 is shown, which includes a face 1002 that extends horizontally from a heel end 1004 to a toe end 1006 and vertically from a sole 1008 to a crown 1010. The heel end 1004 and the toe end 1006 extend from the face 1002 to the rear 1009 of the club head 1000. A transition region between the face 1002 and the crown 1010 defines an upper leading edge 1012 and a transition region between the face 1002 and the sole defines a lower leading edge 1013. The club head 1000 also include a hosel 1014 for receiving a shaft (not shown). The club head 1000 is shown to be a wood-type club head. However, the present disclosure is not limited to wood-type club heads and applies to any type of golf club head (e.g., a driver-type club head, a fairway wood-type club head, a hybrid-type club head, an iron-type club head, a wedge-type club head, or a putter-type club head).

Figure 36:
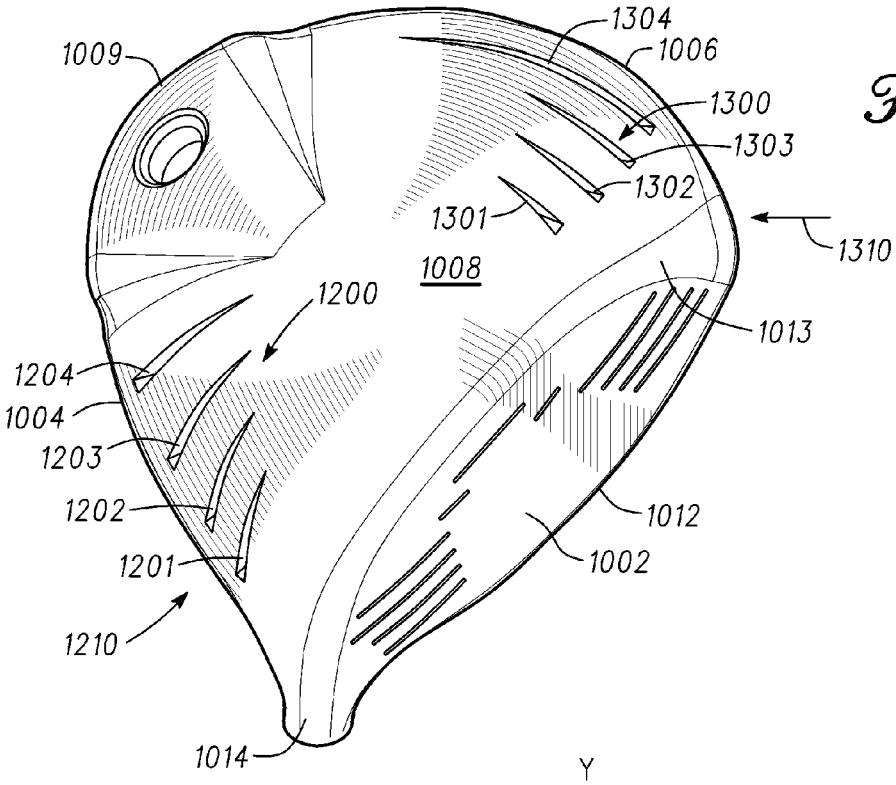
Figure 38:
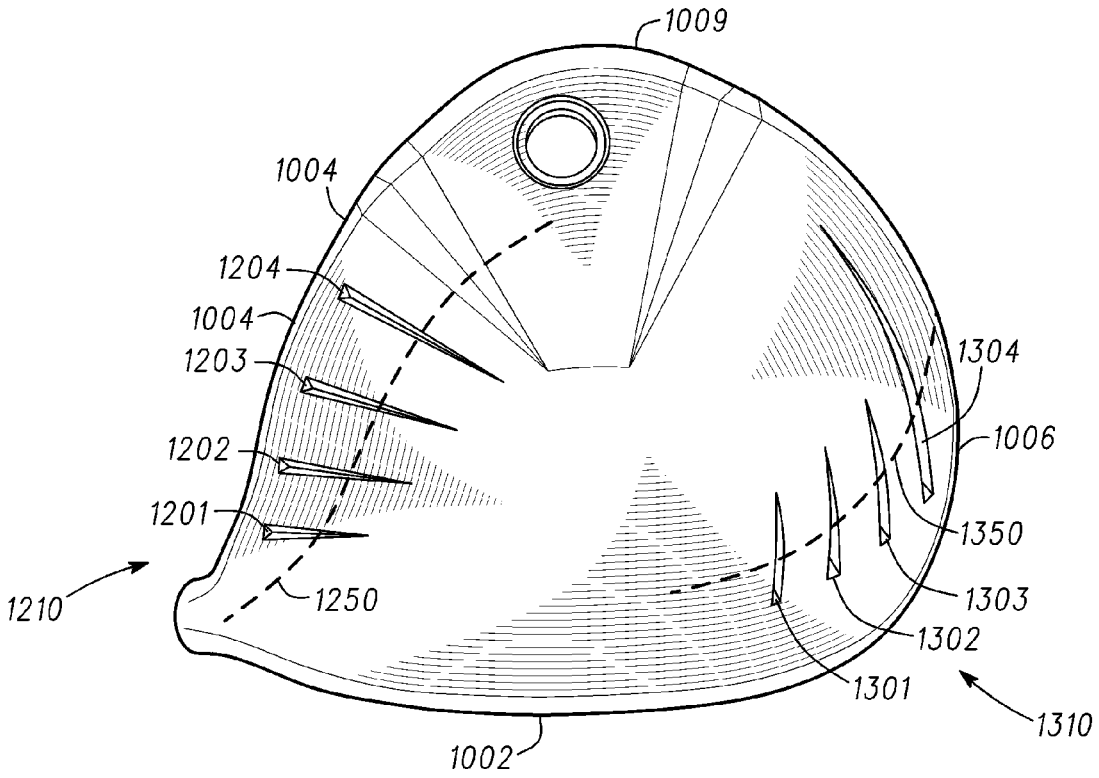

Club head 1000 includes a plurality of turbulators 1201-1204 and 1301-1304 on the sole 1008, which may be generally referred to herein as turbulators 1200 and 1300, respectively. The turbulators 1200 and 1300 energize the boundary layer on the sole 1008 during the downswing, the impact position, and the follow through phases of the golf swing. During the initial part of the downswing, the air that is upstream of the club head 1000 flows generally over the heel 1004 and onto the sole 1008 and the crown 1010. During the intermediate part of the downswing, the air flows generally over the transition area between the heel 1004 and the face 1002 and onto the sole 1008 and the crown 1010. During the final part of the downswing just prior to the impact position, the air flows generally over the face 1002 and onto the sole 1008 and the crown 1010. Arrow 1210 of FIGS. 36 and 38 represents one exemplary direction of airflow during the downswing part of the golf swing. The air flowing over the sole 1008 forms a boundary layer on the sole. The turbulators 1200 energize the boundary layer to delay detachment of the flow downstream of the turbulators 1200. Accordingly, the drag on the club head 1000 is reduced thereby increasing club speed during the downswing.

After the face 1002 strikes the ball in the impact position, the club head 1000 is rotated during the follow through. The air that is upstream of the club head 1000 flows generally over the face 1002 and onto the sole 1008 and the crown 1010 during the initial part of the follow through. During the intermediate part of the follow through, the air flows generally over the transition area between the toe 1006 and the face 1002 and onto the sole 1008 and the crown 1010. During the final part of the follow through, the air may flow generally over the toe 1006 and onto the sole 1008 and the crown 1010. As shown in FIGS. 36 and 38, arrow 1310 represents one exemplary direction of airflow during the follow through part of the golf swing.

Figure 37:
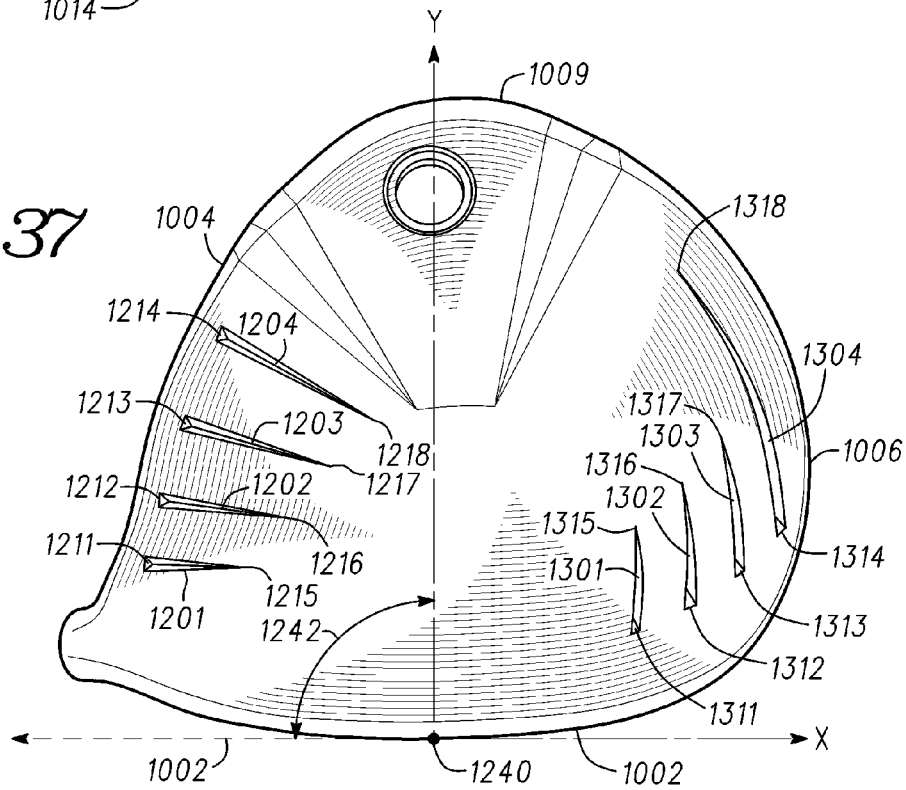

FIG. 37 shows x and y coordinate axes for describing the dimensions, locations on the sole 1008, and orientations relative to the face 1002 of the turbulators 1200 and 1300. The x and y coordinate axes have an origin 1240 (i.e., x=0, y=0), which may define a center point of the face 1002. Accordingly, the y axis may define a center line for the club head 1000. As described in detail below, the location of each turbulator 1200 and 1300 on the sole 1009 can be expressed by an x-location and a y-location. Furthermore, the orientations of the turbulators 1200 and 1300 can be expressed relative to the x axis by an angle 1242.

The turbulators 1201-1204 may be defined by grooves that generally extend from near the heel end 1004 in a direction toward the toe end 1006. Each turbulator 1201-1204 has a first end 1211-1214 and a second end 1215-1218, respectively. The first ends 1211-1214 are located near the heel end 1004 and may generally follow the contour of the heel end 1004. Accordingly, the first ends 1211-1214 of the turbulators 1201-1204 may have approximately the same distance from the heel end 1004. However, the first ends 1211-1214 may be located anywhere on the sole 1008 to delay airflow separation on the sole 1008.

The turbulators 1201-1204 may have the same dimensions and extend parallel to each other or may have different dimensions and extend non-parallel to each other. Depending on the position of the airflow separation region during the downswing, which is shown by example with line 1250 in FIG. 38, the configurations of the turbulators 1200 can be varied to energize the airflow upstream of the separation region 1250. For example, the turbulators 1201-1204 progressively increase in length in a direction from the face 1002 to the rear 1009. Accordingly, the second ends 1215-1218 are progressively nearer to the y axis. Thus, the progressive length increase of the turbulators 1201-1204 may follow the contour of the separation region 1250 so as to provide detached flow on the sole 1008 downstream of the turbulators 1201-1204. Similarly, the depth, the width and/or the angle 1242 of each turbulator 1201-1204 may be varied to provide a particular flow pattern. As shown in FIG. 37, the angle 1242 progressively increases in a direction from the face 1002 to the rear 1009. The angle 1242 for each turbulator 1201-1204 may correspond with a particular rotational position of the club head 1000 during the downswing. Accordingly, by varying the angle 1242 in the direction from the face 1002 to the rear 1009, the turbulators 1201-1204 may energize the flow upstream of the separation region S1 for generally all rotation angles of the club head 1000 during the downswing. The angle 1242 may be measured between any reference line on a turbulator and the x or y axis. In the disclosure, the angle 1242 is measured as the angle between the x-axis and a line connecting the ends of a turbulator.

The grooves defining the turbulators 1201-1204 may be wider at the first ends 1211-1214 and narrower at the second ends 1215-1218, respectively. The depth of the grooves may also gradually decrease from the first ends 1211-1214 to the second ends 1215-1218, respectively. The grooves may be formed in any shape on the sole 1008. For example, the grooves can be narrow at the first ends 1211-1214 and the second ends 1215-1218 and then gradually or abruptly widen toward the centers of the grooves 1201-1204. In contrast, the grooves can be wider at the first ends 1211-1214 and the second ends 1215-1218 and then gradually or abruptly narrow toward the centers of the grooves 1201-1204. The depth of the grooves may also vary in any manner, such as according to the variation in width of the grooves.

The width, length, depth, location (i.e., x and y location), angle 1242, and the shapes of the grooves that define the turbulators 1200 can be varied from the face 1002 to the rear 1009 to provide a particular flow pattern for generally all rotation angles of the club head 1000 during the downswing. Furthermore, the number of turbulators 1200 can also be varied to provide a particular flow pattern on the sole 1008. For example, five, six or more turbulators 1200 can be provided on the sole 1008. The turbulators 1200 may be located on the sole 1008 adjacent to each in a direction from the face 1002 to the rear 1009, and/or may be in tandem.

Table 3 below shows exemplary configurations for the turbulators 1201-1204. The x and y locations refer to the x and y locations of the second ends 1215-1218. All of dimensions in Table 3 are expressed in inches. Furthermore, the depth and width of the grooves defining the turbulators 1201-1204 are measured at the first ends 1211-1214 of the turbulators 1201-1204, respectively. Table 3 represents only an example of the turbulators 1201-1204 and in no way limits the properties of the turbulators 1200.

TABLE 3

| Turbulator | Depth | Length | Width | Location-X | Location-Y | Angle 1242° |
|---|---|---|---|---|---|---|
| 1201 | 0.063 | 1.14 | 0.11 | −1.31 | 1.28 | 2.95 |
| 1202 | 0.065 | 1.28 | 0.11 | −1.01 | 1.67 | 7.97 |
| 1203 | 0.066 | 1.41 | 0.11 | −0.68 | 2.05 | 16.98 |
| 1204 | 0.067 | 1.52 | 0.11 | −0.35 | 2.39 | 30 |

The turbulators 1301-1304 may be defined by grooves that generally extend from near a portion of the face that is close to the toe end 1006 toward the rear 1009. The grooves may also extend generally from near a transition area between the face 1002 and the toe end 1006 toward the rear 1009. Additionally, the grooves may extend from near the toe end 1006 toward the rear 1009. Each turbulator 1301-1304 has a first end 1311-1314 and a second end 1315-1318, respectively. The first ends 1311-1314 are located near the face 1002 or the toe end 1006 and may either extend in a direction from the face 1002 toward the rear 1009 or generally follow the contour of the toe end 1006. However, the first ends 1311-1314 may be located anywhere on the sole 1008 to delay airflow separation on the sole 1008.

The turbulators 1301-1304 may have the same dimensions and extend parallel to each other or may have different dimensions and extend non-parallel to each other. Depending on the position of the airflow separation region, which is shown by example with line 1350 in FIG. 38, the dimensional characteristics of the turbulators 1300 can be varied to energize the airflow upstream of the separation region 1350. For example, the turbulators 1301-1304 progressively increase in length in a direction from the face 1002 toward the toe end 1006 and from the toe end 1006 toward the rear 1009. Accordingly, the second ends 1315-1318 are progressively farther from the x axis and the y-axis. The progressive length increase of the turbulators 1301-1304 may follow the contour of the separation region 1350 to provide attached airflow downstream of the turbulators 1301-1304. Similarly, the depth, the width and/or the angle 1242 of each turbulator 1301-1304 may vary to provide a particular flow pattern. As shown in FIG. 37, the angle 1242 progressively decreases in a direction from the face 1002 toward the toe end 1006 and from the toe end toward the rear 1009. The angle 1242 for each turbulator 1301-1304 may correspond with a particular rotational position of the club head 1000 during follow through. Accordingly, by varying the angle 1242 in the direction from the face 1002 toward the toe end 1006 and from the toe end 1006 toward the rear 1009, the turbulators 1301-1304 may energize the flow upstream of the separation region 1350 for generally all rotation angles of the club head 100 during follow through. Further, each of the turbulators 1301-1304 may have a curvature that generally corresponds to the curvature of the toe end 1006, and may represent the general direction of airflow over the sole 1008 during impact position and follow through. The angle 1242 may be measured between any reference line on a turbulator and the x or y axis. In the disclosure, the angle 1242 is measured as the angle between the x-axis and a line connecting the ends of a turbulator.

The grooves defining the turbulators 1301-1304 may be wider at the first ends 1311-1314 and narrower at the second ends 1315-1318, respectively. The depth of the grooves may also gradually decrease from the first ends 1311-1314 to the second ends 1315-1318, respectively. The grooves may be formed in any shape on the sole 1008. For example, the grooves can be narrow at the first ends 1311-1314 and the second ends 1315-1318 and then gradually or abruptly widen toward the centers of the grooves 1301-1304. In contrast, the grooves can be wider at the first ends 1311-1314 and the second ends 1315-1318 and then gradually or abruptly narrow toward the centers of the grooves 1301-1304. The depth of the grooves may also vary in any manner, such as according to the variation in width of the grooves.

The width, length, depth, location (i.e., x and y location), angle 1242, and the shapes of the grooves defining the turbulators 1300 can be varied from the face 1002 toward the toe end 1006 and from the toe end 1006 toward the rear 1009 to provide a particular flow pattern for generally all rotation angles of the club head 1000 during follow through. Furthermore, the number of turbulators 1300 can also be varied to provide a particular flow pattern on the sole 1008. For example, five, six or more turbulators 1300 can be provided on the sole 1008. The turbulators 1300 may be located on the sole 1008 adjacent to each other and/or in tandem.

Table 4 below shows exemplary configurations for the turbulators 1301-1304. The x and y locations refer to the x and y locations of the second ends 1315-1318. All of the dimensions shown in Table 4 are expressed in inches. Furthermore, the depth and width of the grooves defining the turbulators 1301-1304 are measured at the first ends 1311-1314 of the turbulators 1301-1304, respectively. Table 3 is only an exemplary configuration of the grooves 1301-1304 and in no way limits the properties of the turbulators 1300.

TABLE 4

| Turbulator | Depth | Length | Width | Location-X | Location-Y | Angle 1242° |
|---|---|---|---|---|---|---|
| 1301 | 0.05 | 0.80 | 0.12 | 1.60 | 1.60 | 90.09 |
| 1302 | 0.06 | 0.97 | 0.12 | 1.94 | 1.93 | 86.56 |
| 1303 | 0.07 | 1.09 | 0.12 | 2.24 | 2.27 | 83.03 |
| 1304 | 0.08 | 2.29 | 0.12 | 1.91 | 3.54 | 69.02 |

The turbulator 1200 and 1300 are described above to be defined by grooves in the sole 1008. Accordingly, the turbulators 1200 and 1300 may be formed on the golf club 1000 by cutting the grooves into the sole 1008 of the golf club 1000 by various methods such machining, laser cutting, or the like. Alternatively, any one or more of the turbulators 1200 and/or the turbulators 1300 may be defined by ridges or projections on the sole 1008. Such grooves or ridges may be formed simultaneously with the club head 1000 by stamping (i.e., punching using a machine press or a stamping press, blanking, embossing, bending, flanging, or coining, casting), injection molding, forging, machining or a combination thereof, or other processes used for manufacturing metal parts. With injection molding of metal or plastic materials, a one-piece or a multi-piece mold can be constructed which has interconnected cavities corresponding to the above-described parts of the club head 1000 and/or the turbulators 1200 and 1300. Molten metal or plastic material is injected into the mold, which is then cooled. The club head 1000 and/or the turbulators 1200 and 1300 is then removed from the mold and may be machined to smooth out irregularities on the surfaces thereof or to remove residual parts. If the turbulators 1200 and 1300 are in the form of ridges and are to be manufactured separately from the club head 1000, the turbulator 300 can be fixedly or removably attached to the sole 1008 with fasteners, adhesive, welding, soldering, or other fastening methods and/or devices. In one example, the turbulator 1200 or 1300 may be formed from a strip of material having an adhesive backing. Accordingly, the turbulators 1200 and 1300 may be attached to the club head 1000 at any location on the sole 1008 with the adhesive backing.

A club head may include one or a combination of the turbulators 300, 400, 500, 600, 1200 and/or 1300. For example, a club head may include the turbulators 400 on the crown and turbulators 1200 on the sole. In another example, a club head may include the turbulators 500 on the crown and turbulators 1200 and 1300 on the sole. Thus, any combination of turbulators according to the disclosure may be provided on the crown and/or the sole to provide a particular flow pattern on the club head.

Although a particular order of actions is described above for making turbulators or club heads with turbulators, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A golf club head comprising:

a face, a rear opposite to the face, a heel, a toe opposite to the heel, a crown having a crown surface extending between the face, the rear, the heel and the toe, and a sole opposite to the crown and having a sole surface extending between the face, the rear, the heel and the toe, wherein a highest point on the surface of the crown defines an apex;

a plurality of crown turbulators projecting from the surface of the crown, each adjacent pair of crown turbulators being separate and spaced apart to define a space between the adjacent pair of crown turbulators, and each crown turbulator extending between the heel and the toe to define a width and extending between the face and the rear to define a length;

wherein the length is substantially greater than the width;

wherein at least a portion of at least one crown turbulator is located between the face and the apex; and wherein the space between each adjacent pair of crown turbulators is substantially greater than the width of each of the adjacent pair of crown turbulators that define the space.

2. The golf club of claim 1, wherein the plurality of turbulators comprises a first plurality of turbulators oriented relative to the face in generally a first direction and a second plurality of turbulators oriented relative to the face in generally a second direction different from the first direction.

3. The golf club of claim 1, wherein the plurality of turbulators are oriented relative to the face in generally the same direction.

4. The golf club of claim 1, wherein each turbulator is oriented relative to the face in generally a first direction and an adjacent turbulator is oriented relative to the face in generally a second direction different from the first direction.

5. The golf club of claim 1, wherein the length of each turbulator is oriented relative to the face at an angle of greater than 0° and less than 90°.

6. The golf club of claim 1, wherein the length of each turbulator is oriented relative to the face at an angle between around 20° and around 70°.

7. The golf club of claim 1, wherein the space between each adjacent pair of turbulators is defined by a section of the surface of the crown.

8. The golf club head of claim 1, further comprising a plurality of sole turbulators disposed on the sole surface.

9. The golf club head of claim 8, wherein each of the sole turbulators is defined by a groove in the sole surface having a width and a length substantially greater than the width.

10. The golf club head of claim 8, wherein at least one of the sole turbulators is located in a portion of the sole surface between the heel and a centerline extending from a center of the face to the rear.

11. The golf club head of claim 10, wherein the at least one sole turbulator has a first end located near the heel and extending generally toward the toe to a second end.

12. The golf club head of claim 8, wherein at least one of the sole turbulators is located in a portion of the sole surface between the toe and a centerline extending from a center of the face to the rear.

13. The golf club head of claim 12, wherein the at least one sole turbulator has a first end located near the face or the toe and extending generally toward the toe to a second end.

14. A golf club head comprising:

a face, a rear opposite to the face, a heel, a toe opposite to the heel, a crown having a crown surface extending between the face, the rear, the heel and the toe, and a sole opposite to the crown and having a sole surface extending between the face, the rear, the heel and the toe;

a first plurality of sole turbulators defined by grooves disposed in a portion of the sole surface between the heel and a centerline extending from a center of the face to the rear, at least one sole turbulator of the first plurality of sole turbulators extending from near the heel in a direction generally toward the toe; and a second plurality of sole turbulators defined by grooves disposed in a portion of the sole surface between the toe and the centerline on the sole surface, at least one sole turbulator of the second plurality of sole turbulators extending from near the face or the toe in a direction generally toward the rear;

wherein a width of at least one sole turbulator of the first plurality of sole turbulators or the second plurality of sole turbulators varies along a length of the at least one sole turbulator.

15. The golf club head of claim 14, further comprising a plurality of crown turbulators disposed on the crown.

16. The golf club head of claim 15, wherein at least a portion of at least one crown turbulator is located between the face and an apex defined by a highest point on the surface of the crown.

17. The golf club head of claim 15, wherein each adjacent pair of crown turbulators is separate and spaced apart to define a space between the adjacent pair of crown turbulators, and wherein each space is substantially greater than a width of each of the adjacent pair of crown turbulators that define the space.

18. The golf club head of claim 14, wherein each of the plurality of first sole turbulators comprises a first end and a second end, and wherein the first end and the second end define a line extending in the same general direction as the heel.

19. The golf club head of claim 14, wherein the lengths of at least two sole turbulators of the first plurality of sole turbulators or the second plurality of sole turbulators are different.

20. The golf club head of claim 14, wherein at least two sole turbulators of the plurality of first sole turbulators or the plurality of second sole turbulators are generally parallel.

21. The golf club head of claim 14, wherein at least two sole turbulators of the plurality of first sole turbulators or the plurality of second sole turbulators are generally non-parallel.

22. The golf club head of claim 14, wherein the lengths of the plurality of first sole turbulators progressively increase in a direction extending from the heel to the toe.

23. The golf club head of claim 14, wherein the lengths of the plurality of second sole turbulators progressively increase in a direction extending from the face or the toe to the rear.

24. A method for providing turbulators on a club head comprising:

providing a club head comprising a face, a rear opposite to the face, a heel, a toe opposite to the heel, a crown having a crown surface extending between the face, the rear, the heel and the toe, and a sole opposite to the crown and having a sole surface extending between the face, the rear, the heel and the toe, wherein a highest point on the surface of the crown defines an apex;

forming a plurality of crown turbulators projecting from the surface of the crown, each adjacent pair of crown turbulators being separate and spaced apart to define a space between the adjacent pair of crown turbulators, and each crown turbulator extending between the heel and the toe to define a width and extending between the face and the rear to define a length;

wherein the length is substantially greater than the width;

wherein at least a portion of at least one crown turbulator is located between the face and the apex; and wherein each space between an adjacent pair of crown turbulators is substantially greater than the width of each of the adjacent pair of crown turbulators that define the space.

25. The method of claim 24, wherein forming the plurality of crown turbulators comprises forming the club head and the plurality of turbulators together.

26. The method of claim 24, wherein forming the plurality of crown turbulators comprises attaching the plurality of crown turbulators on the crown.

27. The method of claim 24, further comprising forming a first plurality of sole turbulators on the sole, wherein the first plurality of sole turbulators is defined by grooves disposed in a portion of the sole surface between the heel and a centerline extending from a center of the face to the rear, at least one sole turbulator of the first plurality of sole turbulators extending from near the heel in a direction generally toward the toe.

28. The method of claim 24, further comprising forming a second plurality of sole turbulators on the sole, wherein the second plurality of sole turbulators is defined by grooves disposed in a portion of the sole surface between the toe and the centerline on the sole surface, at least one sole turbulator of the second plurality of sole turbulators extending from near the face or the toe in a direction generally toward the rear.

* * * * *

UNITED STATES PATENT AND TRADEMARK OFFICE

CERTIFICATE OF CORRECTION

PATENT NO. : 8,608,587 B2
APPLICATION NO. : 13/536753
DATED : December 17, 2013
INVENTOR(S) : Henrikson et al.

It is certified that error appears in the above-identified patent and that said Letters Patent is hereby corrected as shown below:

On Title Page, Item (75):
Delete "John Hert, Sheffield (GB)" and replace with --John Hart, Sheffield (GB)--

Signed and Sealed this
Eighteenth Day of November, 2014

Michelle K. Lee

Michelle K. Lee
*Deputy Director of the United States Patent and Trademark Office*